US006288485B1

(12) United States Patent
Takegami et al.

(10) Patent No.: US 6,288,485 B1
(45) Date of Patent: Sep. 11, 2001

(54) ELECTRON APPARATUS USING ELECTRON-EMITTING DEVICE AND IMAGE FORMING APPARATUS

(75) Inventors: Tsuyoshi Takegami, Atsugi; Hideaki Mitsutake, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/064,511

(22) Filed: Apr. 23, 1998

(30) Foreign Application Priority Data

Apr. 28, 1997 (JP) ..... 9-111573
Apr. 10, 1998 (JP) ..... 10-099192

(51) Int. Cl.[7] ..... H01J 1/62; H01J 63/04
(52) U.S. Cl. ..... 313/495; 313/496; 313/497
(58) Field of Search ..... 313/495, 309, 313/310, 351, 336, 292, 496, 497, 238, 243, 609, 610, 621, 240, 250

(56) References Cited

U.S. PATENT DOCUMENTS

| | | | | |
|---|---|---|---|---|
| 4,904,895 | | 2/1990 | Tsukamoto et al. | 313/336 |
| 5,066,833 | | 11/1991 | Zalenski | 178/19 |
| 5,374,868 | * | 12/1994 | Tjaden et al. | 313/310 |
| 5,438,240 | * | 8/1995 | Cathey et al. | 313/309 |
| 5,619,097 | | 4/1997 | Jones | 313/495 |
| 5,729,086 | | 3/1998 | Jeong | 313/495 |
| 5,905,335 | * | 5/1999 | Fushimi et al. | 313/495 |
| 5,936,343 | * | 8/1999 | Fushimi et al. | 313/310 |
| 5,939,823 | * | 8/1999 | Kiyomiya et al. | 313/495 |
| 5,945,780 | * | 8/1999 | Ingle et al. | 313/495 |
| 5,952,775 | * | 9/1999 | Sato et al. | 313/495 |
| 6,005,540 | * | 12/1999 | Shinjo et al. | 313/309 |

FOREIGN PATENT DOCUMENTS

| | | |
|---|---|---|
| 0523702A | 1/1993 | (EP) . |
| 2736464A | 1/1997 | (FR) . |
| 64-31332A | 2/1989 | (JP) . |
| 2-257551A | 10/1990 | (JP) . |
| 3-55738A | 3/1991 | (JP) . |
| 4-28137A | 1/1992 | (JP) . |
| 08-7809 | 1/1996 | (JP) . |
| 9606450A | 2/1996 | (WO) . |

OTHER PUBLICATIONS

Ajluni, C.,"Advanced Display Technologies come to Light," *Electronic Design,* 1996, vol. 44, pp. 93–102, "Dec. 1996".

(List continued on next page.)

*Primary Examiner*—Nimeshkumar D. Patel
*Assistant Examiner*—Mariceli Santiago
(74) *Attorney, Agent, or Firm*—Fitzpatrick, Cella, Harper & Scinto

(57) ABSTRACT

This invention discloses an electron apparatus with electron-emitting devices in which a support member maintains the interval between a first substrate having the electron-emitting devices and a second substrate facing the first substrate. In this arrangement, the support member is made of an insulating material, and of a plurality of electron-emitting devices arranged substantially linearly, two electron-emitting devices adjacent to each other through the support member are arranged at a larger interval than the interval between two electron-emitting devices adjacent to each other without the mediacy of the support member.

20 Claims, 21 Drawing Sheets

OTHER PUBLICATIONS

Dyke, W.P., et al., "Field Emission" in *Advances in Electronics and Electron Physics, Academic Press Inc.*, 1956, vol. VIII, pp. 89–185, "No Month".

Mead, C.A., "Operation of Tunnel–Emission Devices," *Journal of Applied Physics*, 1961, vol. 32, pp. 646–652, "Jan.–Dec., 1961".

Spindt, C.A., et al., "Physical properties of thin–film field emission cathodes with molybdenum cones," *Journal of Applied Physics*, 1976, vol. 47, p. 5248–263, "Dec.".

Elinson, M. I., et al., "The Emission of Hot Electrons and the Field Emission of Electrons from Tin Oxide," 1965, *Radio Engineering and Electronic Physics*, vol. 7, pp. 1290–1296, "Jul., 1965".

Dittmer, G., "Electrical Conduction and Electron Emission of Discontinuous Thin Films," *Thin Solid Films,* 1972, vol. 9, pp. 317–328, "No Month".

Hartwell, M., et al., Strong Electron Emission From Patterned Tin–Indium Oxide Thin Films, *International Electron Devices Meeting*, 1975, pp. 519–521, "No Month".

Araki, Hisashi, "Electroforming and Electron Emission of Carbon Thin Films," *Journal of the Vacuum Society of Japan*, 1981, vol. 26, p. 22–29, "Sep.".

* cited by examiner

ELECTRON APPARATUS USING ELECTRON-EMITTING DEVICE AND IMAGE FORMING APPARATUS

BACKGROUND OF THE INVENTION

1. Field of the Invention

The present invention relates to an electron apparatus associated with electron emission and, more particularly, to an image forming apparatus for forming an image by electrons.

2. Description of the Related Art

Conventionally, two types of devices, namely hot and cold cathode devices, are known as electron-emitting devices. Known examples of the cold cathode devices are surface-conduction emission (SCE) type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio Eng. Electron Phys., 10, 1290 (1965) and other examples will be described later.

The surface-conduction emission type electron-emitting device utilizes the phenomenon that electrons are emitted from a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 17 is a plan view showing the device proposed by M. Hartwell et al. described above as a typical example of the device structures of these surface-conduction emission type electron-emitting devices. Referring to FIG. 17, numeral 3001 denotes a substrate; and 3004, a conductive thin film made of a metal oxide formed by sputtering. This conductive thin film 3004 has an H-shaped pattern, as shown in FIG. 17. An electron-emitting portion 3005 is formed by performing electrification processing (referred to as forming processing to be described later) with respect to the conductive thin film 3004. An interval L in FIG. 17 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion 3005.

In the above surface-conduction emission type electron-emitting devices by M. Hartwell et al. and the like, typically the electron-emitting portion 3005 is formed by performing electrification processing called forming processing for the conductive thin film 3004 before electron emission. That is, the forming processing is to form an electron-emitting portion by electrification. For example, a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

FIG. 18 is a cross-sectional view showing the device proposed by C. A. Spindt et al. described above as a typical example of the FE type device structure. Referring to FIG. 18, numeral 3010 denotes a substrate; 3011, an emitter wiring layer made of a conductive material; 3012, an emitter cone; 3013, an insulating layer; and 3014, a gate electrode. In this device, a voltage is applied between the emitter cone 3012 and the gate electrode 3014 to emit electrons from the distal end portion of the emitter cone 3012. As another FE type device structure, there is an example in which an emitter and a gate electrode are arranged on a substrate to be almost parallel to the surface of the substrate, in addition to the multilayered structure of FIG. 18.

A known example of the MIM type electron-emitting devices is described in C. A. Mead, "Operation of Tunnel-Emission Devices", J. Appl. Phys., 32,646 (1961). FIG. 19 shows a typical example of the MIM type device structure. FIG. 19 is a cross-sectional view of the MIM type electron-emitting device. Numeral 3020 denotes a substrate; 3021, a lower electrode made of a metal; 3022, a thin insulating layer having a thickness of about 100 A; and 3023, an upper electrode made of a metal and having a thickness of about 80 to 300 A. In the MIM type electron-emitting device, an appropriate voltage is applied between the upper electrode 3023 and the lower electrode 3021 to emit electrons from the surface of the upper electrode 3023.

Since the above-described cold cathode devices can emit electrons at a temperature lower than that for hot cathode devices, they do not require any heater. The cold cathode device therefore has a structure simpler than that of the hot cathode device and can be micropatterned. Even if a large number of devices are arranged on a substrate at a high density, problems such as heat fusion of the substrate hardly arise. In addition, the response speed of the cold cathode device is high, while the response speed of the hot cathode device is low because it operates upon heating by a heater. For this reason, applications of the cold cathode devices have enthusiastically been studied.

Of cold cathode devices, the above surface-conduction emission type electron-emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface-conduction emission type electron-emitting devices to, e.g., image forming apparatuses such as an image display apparatus and an image recording apparatus, electron-beam sources, and the like have been studied.

As an application to image display apparatuses, in particular, as disclosed in the U.S. Pat. No. 5,066,883 and Japanese Patent Laid-Open Nos. 2-257551 and 4-28137 filed by the present applicant, an image display apparatus using the combination of an surface-conduction emission type electron-emitting device and a fluorescent substance which emits light upon reception of an electron beam has been studied. This type of image display apparatus using the combination of the surface-conduction emission type electron-emitting device and the fluorescent substance is expected to have more excellent characteristics than other conventional image display apparatuses. For example, in comparison with recent popular liquid crystal display apparatuses, the above display apparatus is superior in that it does not require a backlight because it is of a self-emission type and that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat display apparatus reported by R. Meyer et al. [R. Meyer: "Recent Development on Microtips Display at LETI", Tech. Digest of 4th Int. Vacuum Microelectronics Conf., Nagahama, pp. 6–9 (1991)].

An example of an application of a larger number of MIM type electron-emitting devices arranged side by side to an image display apparatus is disclosed in Japanese Patent Laid-open No. 3-55738 filed by the present applicant.

Of image display apparatuses using electron-emitting devices like the ones described above, a thin, flat display apparatus receives a great deal of attention as an alternative to a CRT (Cathode-Ray Tube) display apparatus be cause of a small space and light weight.

FIG. 20 is a perspective view of an example of a display panel for a flat image display apparatus where a portion of the panel is removed for showing the internal structure of the panel.

In FIG. 20, numeral 3115 denotes a rear plate; 3116, a side wall; and 3117, a face plate. The rear plate 3115, the side wall 3116, and the face plate 3117 form an envelope (airtight container) for maintaining the inside of the display panel vacuum.

The rear plate 3115 has a substrate 3111 fixed thereto, on which N×M cold cathode devices 3112 are provided (M, N=positive integer equal to "2" or greater, appropriately set in accordance with an object number of display pixels). The N×M cold cathode devices 3112 are wired in a simple matrix by M row-direction wirings 3113 and N column-direction wirings 3114. The portion constituted with the substrate 3111, the cold cathode devices 3112, the row-direction wiring 3113, and the column-direction wiring 3114 will be referred to as "multi electron-beam source". At an intersection of the row-direction wiring 3113 and the column-direction wiring 3114, an insulating layer (not shown) is formed between the wirings, to maintain electrical insulation.

Further, a fluorescent film 3118 made of a fluorescent substance is formed under the face plate 3117. The fluorescent film 3118 is colored with red, green and blue, three primary color fluorescent substances (not shown). Black conductive material (not shown) is provided between the fluorescent substances constituting the fluorescent film 3118. Further, a metal back 3119 made of aluminum or the like is provided on the surface of the fluorescent film 3118 on the rear plate 3115 side. Symbols Dx1 to DxM, Dy1 to DyN, and Hv denote electric connection terminals for the airtight structure provided for electrical connection of the display panel with an electric circuit (not shown). The terminals Dx1 to DxM are electrically connected to the row-direction wiring 3113 of the multi electron-beam source; Dy1 to DyN, to the column-direction wiring 3114; and Hv, to the metal back 3119 of the face plate.

The inside of the airtight container is exhausted at about $10^{-6}$ Torr. As the display area of the image display apparatus becomes larger, the image display apparatus requires a means for preventing deformation or damage of the rear plate 3115 and the face plate 3117 caused by a difference in pressure between the inside and outside of the airtight container. If the deformation or damage is prevented by making the rear plate 3115 and the face plate 3117 thick, not only the weight of the image display apparatus increases, but also image distortion and parallax are caused when the user views the image from an oblique direction. To the contrary, in FIG. 20, the display panel comprises a structure support member (called a spacer or rib) 3120 made of a relatively thin glass to resist the atmospheric pressure. With this structure, the interval between the substrate 3111 on which the multi beam-electron source is formed, and the face plate 3117 on which the fluorescent film 3118 is formed is normally kept at submillimeters to several millimeters. As described above, the inside of the airtight container is maintained at high vacuum.

In the image display apparatus using the above-described display panel, when a voltage is applied to the cold cathode devices 3112 via the outer terminals Dx1 to DxM and Dy1 to DyN, electrons are emitted by the cold cathode devices 3112. At the same time, a high voltage of several hundreds V to several kV is applied to the metal back 3119 via the outer terminal Hv to accelerate the emitted electrons and cause them to collide with the inner surface of the face plate 3117. Consequently, the respective fluorescent substances constituting the fluorescent film 3118 are excited to emit light, thereby displaying an image.

The above-mentioned electron beam apparatus of the image forming apparatus or the like comprises an envelope for maintaining vacuum inside the apparatus, electron sources arranged inside the envelope, a face plate having fluorescent substances on which electron beams emitted by the electron sources are irradiated, an acceleration electrode for accelerating the electron beams toward the face plate having the fluorescent substances, and the like. In addition to them, a support member (spacer) for supporting the envelope from its inside against the atmospheric pressure applied to the envelope is arranged inside the envelope.

The panel of this image display apparatus comprising the spacer suffers the following problem.

This problem will be explained with reference to FIG. 21. FIG. 21 is a cross-sectional view taken along the line A—A in FIG. 20. The same reference numerals as in FIG. 20 denote the same parts, and a description thereof will be omitted.

Numeral 3120 denotes a spacer, which is arranged between a substrate 3111 and a face plate 3117. Electrons emitted by cold cathode devices 3112 follow orbits 4112 to collide with a fluorescent film 3118, and cause fluorescent substances to emit light, thereby forming an image. Some of electrons emitted near the spacer 3120 strike the spacer 3120, or ions produced by the action of emitted electrons attach to the spacer 3120. Further, some of electrons which have reached the face plate 3117 are reflected and scattered, and some of the scattered electrons strike the spacer 3120 to charge the spacer 3120. The orbits of electrons emitted by the cold cathode devices 3112 near the spacer are changed by the charge-up of the spacer 3120 in the direction close to the spacer 3120. Accordingly, the electrons emitted by the cold cathode devices 3112 collide with positions different from proper positions on the fluorescent film 3118 to display a distorted image near the spacer. If the emitted electrons collide with the spacer 3120, they cannot reach the fluorescent film 3118, and thus the luminance decreases near the spacer 3120.

It is an object of the present invention to provide an electron apparatus capable of preferably setting an electron irradiation position near a support member, and an image forming apparatus using the electron apparatus.

SUMMARY OF THE INVENTION

An aspect of an electron apparatus according to the present invention has the following arrangement.

There is provided an electron apparatus comprising:

a first substrate having a plurality of electron-emitting devices arranged substantially linearly;

a second substrate arranged to face the first substance; and a support member for maintaining an interval between the first substrate and the second substrate, wherein the support member has an insulating property, and of the plurality of electron-emitting devices, two electron-emitting devices adjacent to each other through the support member are arranged at a larger interval than an interval between two electron-emitting devices adjacent to each other without mediacy of the support member.

Another aspect of an electron apparatus according to the present invention has the following arrangement.

There is provided an electron apparatus comprising:

a first substrate having a plurality of electron-emitting devices arranged substantially linearly;

a second substrate arranged to face the first substance; and a support member for maintaining an interval between the first substrate and the second substrate, wherein the support member has a characteristic of keeping a charge amount almost constant, and of the plurality of electron-emitting devices, two electron-emitting devices adjacent to each other through the support member are arranged at a larger interval than an interval between two electron-emitting devices adjacent to each other without mediacy of the support member.

Particularly in the present invention, the electron-emitting devices are driven at a certain period, and the characteristic of the support member for keeping the charge amount almost constant is a characteristic capable of suppressing a change in charge amount within an allowable range for a change in deflection amount applied to electrons emitted by the electron-emitting devices upon a change in charge amount of the support member during at least the certain period.

In the respective aspects, since the support member has an insulating property or a characteristic of keeping the charge amount almost constant, deflection of electrons by the charge-up of the support member is kept almost constant. If the arrangement interval between the electron-emitting devices is set such that the two electron-emitting devices adjacent to each other through the support member are arranged at a larger interval than the interval between the two electron-emitting devices adjacent to each other without the mediacy of the support member, collision of electrons with the support member can be suppressed, and the shift amount of the electron irradiation position from a desired position can be decreased near the support member. In addition, variations in electron irradiation position can be suppressed.

More specifically, the support member has a surface sheet resistance of preferably not less than $10^{11}$ Ω/sq, and more preferably not less than $10^{12}$ Ω/sq.

In the respective aspects, A1>(A2+t) preferably holds, where A1 is an interval between the two electron-emitting devices adjacent to each other through the support member, A2 is an interval between the two electron-emitting devices adjacent to each other without mediacy of the support member, and t is a thickness of the support member in a direction to connect the two electron-emitting devices adjacent to each other through the support member.

In the respective aspects, the interval between the two electron-emitting devices adjacent to each other through the support member is preferably set in accordance with a degree of influence on irradiation positions of electrons emitted by the electron-emitting devices owing to deflection of the electrons by the support member.

More specifically, the interval between the two electron-emitting devices adjacent to each other through the support member is set in accordance with the shift amount of the electron irradiation position obtained when electrons are deflected by the support member from the electron irradiation position obtained when electrons are not deflected by the support member.

In the respective aspects, the interval between the two electron-emitting devices adjacent to each other through the support member is so set as to make an interval between irradiation points of electrons emitted by the two electron-emitting devices be almost equal to an interval between irradiation points of electrons emitted by the two electron-emitting devices adjacent to each other without mediacy of the support member. With this setting, the electron irradiation points can be formed at almost the same interval regardless of the presence of the support member.

In the respective aspects, the interval between the two electron-emitting devices adjacent to each other through the support member is preferably set in accordance with at least one of a voltage for accelerating electrons emitted by the electron-emitting devices, a height of the support member, and a charge amount of the support member. More specifically, the voltage for accelerating electrons emitted by the electron-emitting devices is a voltage applied across the electron-emitting devices and the second substrate.

In the respective aspects, the electron apparatus may further comprise a plurality of sets of electron-emitting devices arranged substantially linearly.

In the respective aspects, the plurality of electron-emitting devices may be wired in a matrix by a row-direction wiring and a column-direction wiring extending in a direction different from a direction of the row-direction wiring. At this time, the support member is desirably arranged on either one of the row-direction wiring and the column-direction wiring.

The extending direction of the row- or column-direction wiring may be made to coincide with the direction to arrange the cold cathode electron-emitting devices substantially linearly.

In the respective aspect, the electron-emitting device is a cold cathode type electron-emitting device.

In the respective aspects, the electron-emitting device has a pair of electrodes and emits an electron upon application of a voltage to the pair of electrodes. For example, the pair of electrodes are an emitter cone and a gate electrode for an FE type electron-emitting device, two electrodes stacked sandwiching an insulating layer therebetween for an MIM type electron-emitting device, or two parallel electrodes for a surface-conduction emission type electron-emitting device.

According to the present invention, there is provided an image forming apparatus for forming an image by irradiation of an electron, comprising the electron apparatus defined in either one of the aspects, and an image forming member on which an image is formed by an electron emitted by the electron-emitting device of the electron apparatus.

The image forming member is a light-emitting substance which emits light upon irradiation of an electron. The light-emitting substance is, e.g., a fluorescent substance.

The image forming member may be arranged on the second substrate of the electron apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 16A and 16B are plan views of the display panel in the embodiment of the present invention, in which FIG. 16A shows a region sufficiently spaced apart from a spacer, and FIG. 16B shows a region near the spacer;

DETAILED DESCRIPTION OF THE PREFERRED EMBODIMENTS

A preferred embodiment of the present invention will be described in detail below with reference to the accompanying drawings.

First, the construction of a display panel of an image display apparatus to which the embodiment of the present invention is applied and a method for manufacturing the display panel will be described below.

Figure 1:
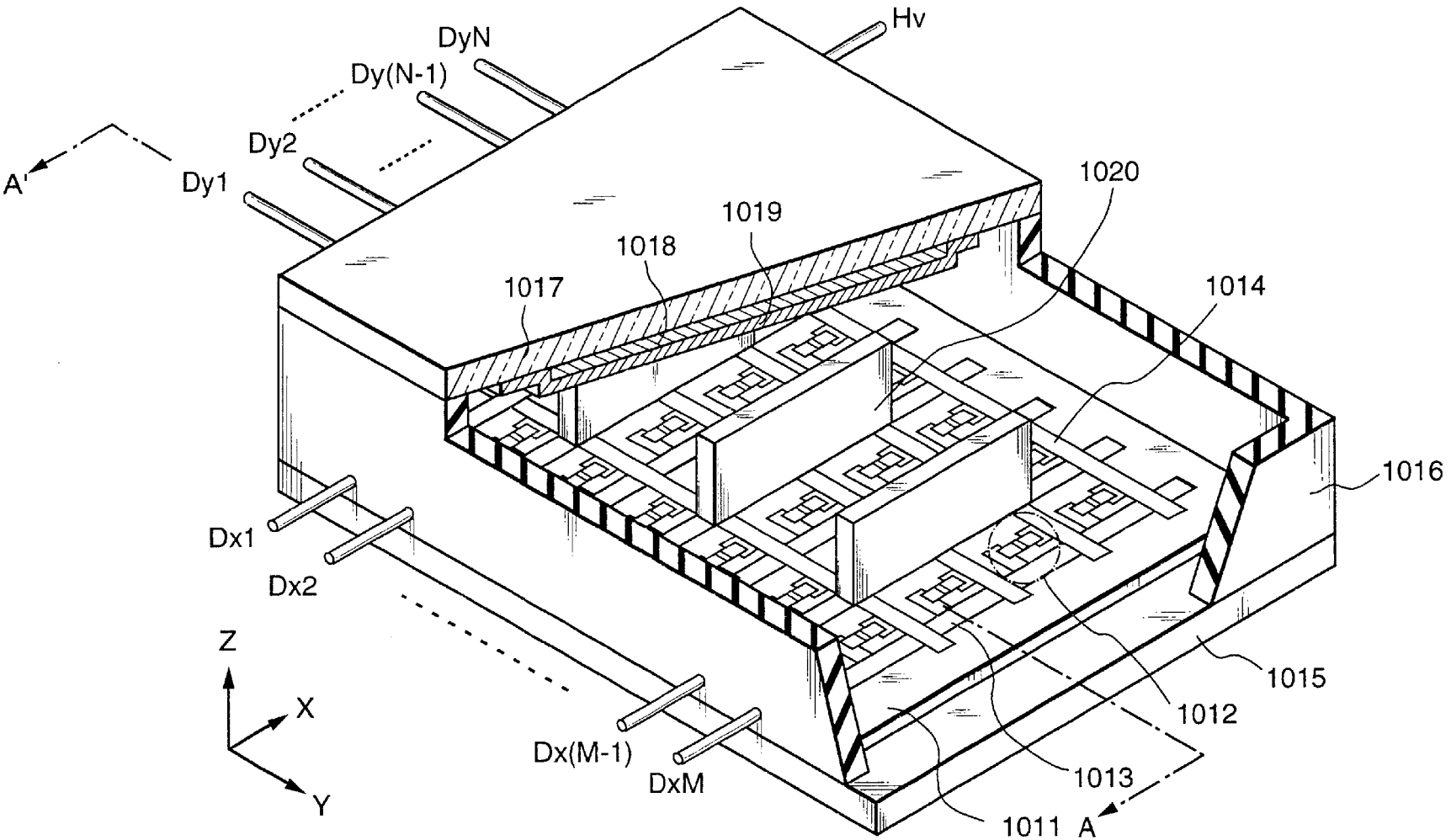
FIG. 1 is a partially cutaway perspective view showing the display panel of an image display apparatus according to an embodiment of the present invention.

FIG. 1 is a perspective view of the display panel where a portion of the panel is removed for showing the internal structure of the panel.

In FIG. 1, numeral 1015 denotes a rear plate; 1016, a side wall; and 1017, a face plate. These parts form an airtight container for maintaining the inside of the display panel vacuum. To construct the airtight container, it is necessary to seal-connect the respective parts to obtain sufficient strength and maintain airtight condition. For example, a frit glass is applied to junction portions, and sintered at 400 to 500° C. in air or nitrogen atmosphere, thus the parts are seal-connected. A method for exhausting air from the inside of the container will be described later. Since the inside of the airtight container is kept exhausted at about $10^{-6}$ Torr, a spacer 1020 is arranged as a structure resistant to the atmospheric pressure in order to prevent damage of the airtight container caused by the atmospheric pressure or sudden shock.

The rear plate 1015 has a substrate 1011 fixed there, on which N×M cold cathode devices 1012 are provided (M, N=positive integer equal to "2" or greater, appropriately set in accordance with an object number of display pixels. For example, in a display apparatus for high-quality television display, desirably N=3000 or greater, M=1000 or greater. In this embodiment, N=3072, M=1024.). The N×M cold cathode devices 1012 are wired in a simple matrix by M row-direction wirings 1013 and N column-direction wirings 1014. The portion constituted with these parts 1011 to 1014 will be referred to as "multi electron-beam source".

In the multi electron-beam source used in the image display apparatus according to the embodiment of the present invention, the material, shape, and manufacturing method of the cold cathode device are not limited as far as an electron source is prepared by wiring cold cathode devices in a simple matrix. Therefore, the multi electron-beam source can employ a surface-conduction emission (SCE) type electron-emitting device or an FE type or MIM type cold cathode device.

Figure 2:
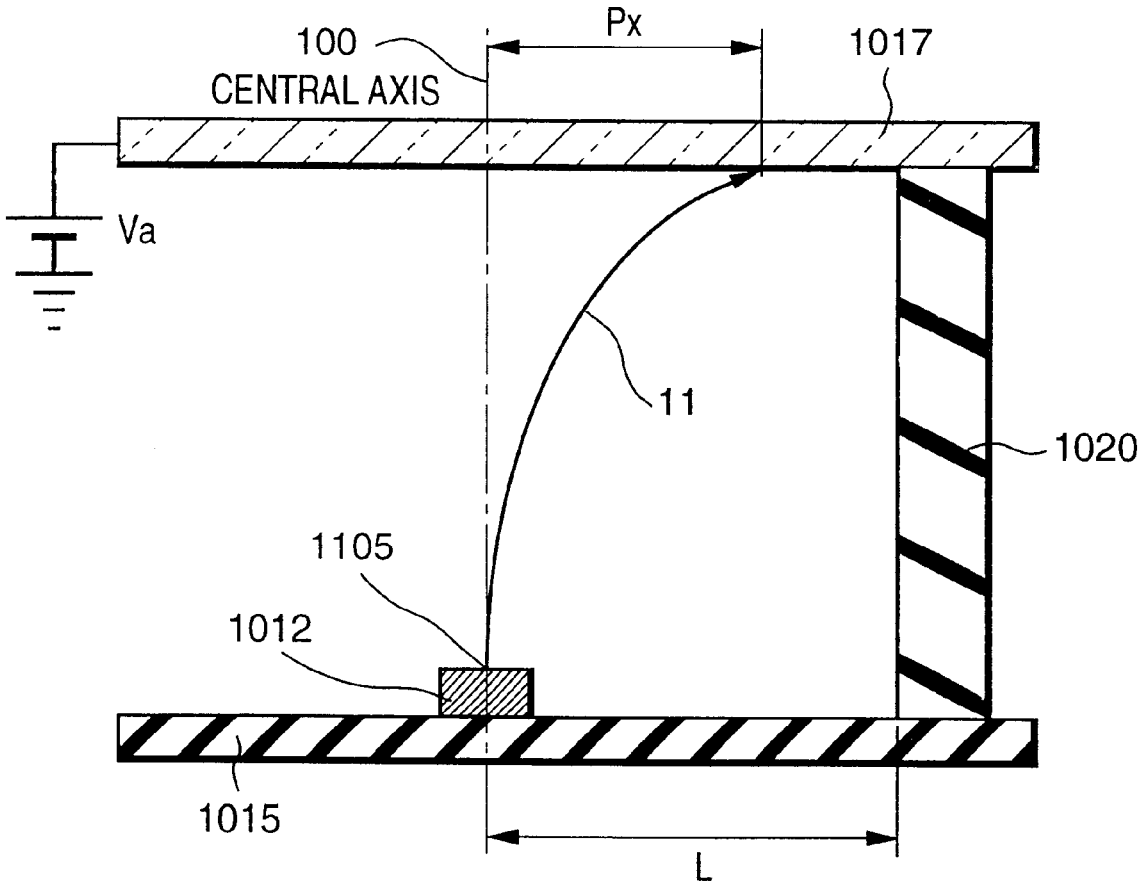
FIG. 2 is a schematic cross-sectional view of the image display apparatus according to the embodiment of the present invention.

The basic principle of the embodiment of the present invention will be described with reference to FIG. 2. FIG. 2 is a cross-sectional view taken along the line A–A' in FIG. 1 that shows the section of the image forming apparatus according to the present invention.

Numeral 1017 denotes a face plate including fluorescent substances and a metal back; 1015, a rear plate including an electron source substrate; 1020, a spacer; 1012, a cold cathode device; and 1105, an electron-emitting portion of the cold cathode device. When a driving voltage Vf (not shown) is applied to the device 1012, and an anode voltage Va is applied to the face plate 1017 side, an electron emitted by the cold cathode device 1012 follows an orbit 11.

If the spacer 1020 and the device 1012 have the positional relationship shown in FIG. 2, the field distribution changes under the influence of the positively charged spacer 1020 to bend the orbit 11 of the electron beam toward the spacer 1020. Letting L be the distance between the spacer 1020 and the device 1012, and Px be the distance between a central axis 100 of the device and the electron collision position on the face plate 1017, the bending of the electron orbit is determined by the distance L from the charged spacer 1020. By appropriately adjusting the device position and changing the distance L, an electron can be projected on a desired position on a fluorescent substance of the face plate 1017.

(General Description of Image Display Apparatus)

The structure of the multi electron-beam source prepared by arranging SCE type electron-emitting devices (to be described later) as cold cathode devices on a substrate and wiring them in a simple matrix will be described.

Figure 3:
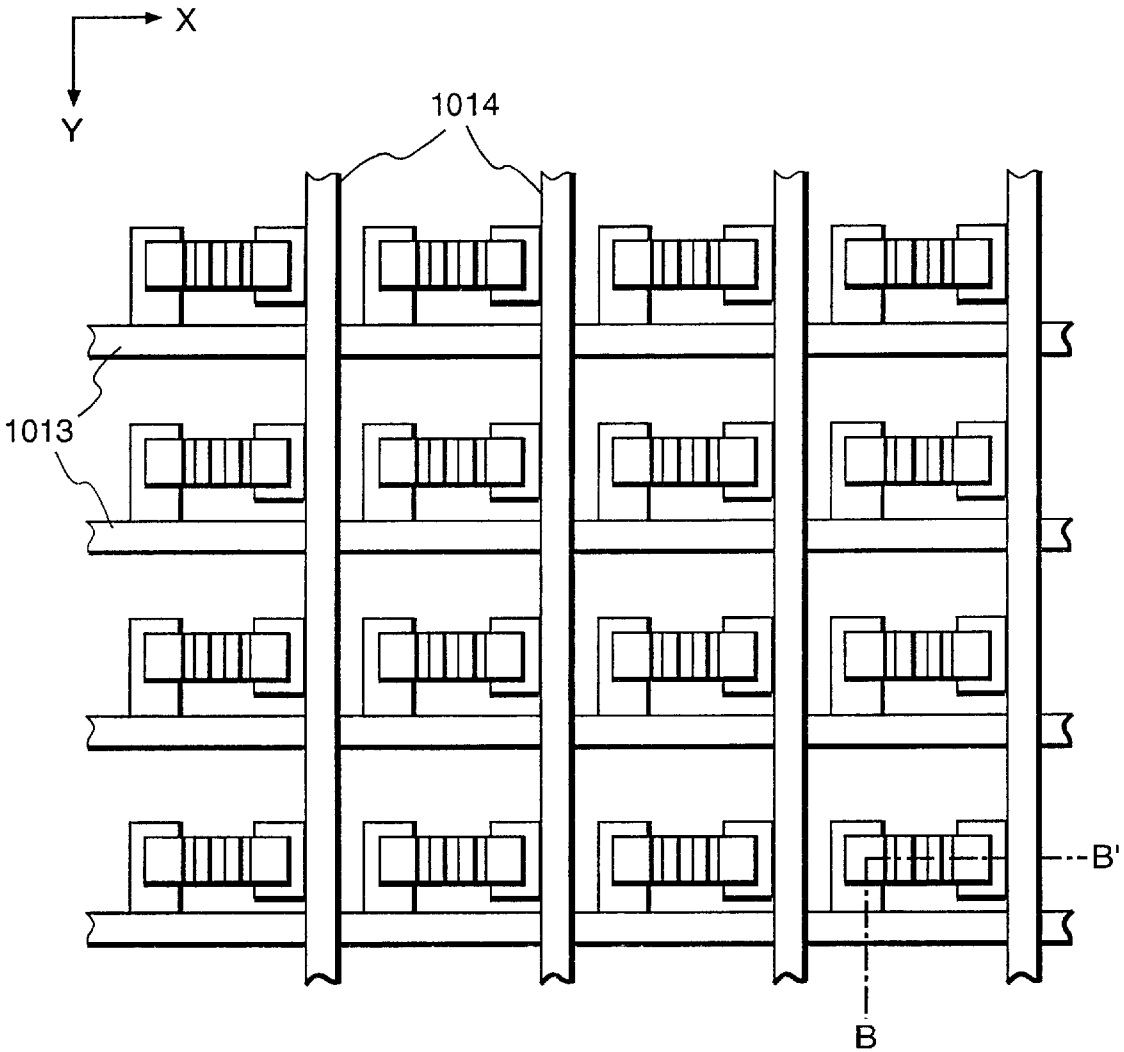
FIG. 3 is a plan view of the substrate of a multi electron-beam source used in the embodiment.
Figure 6A:
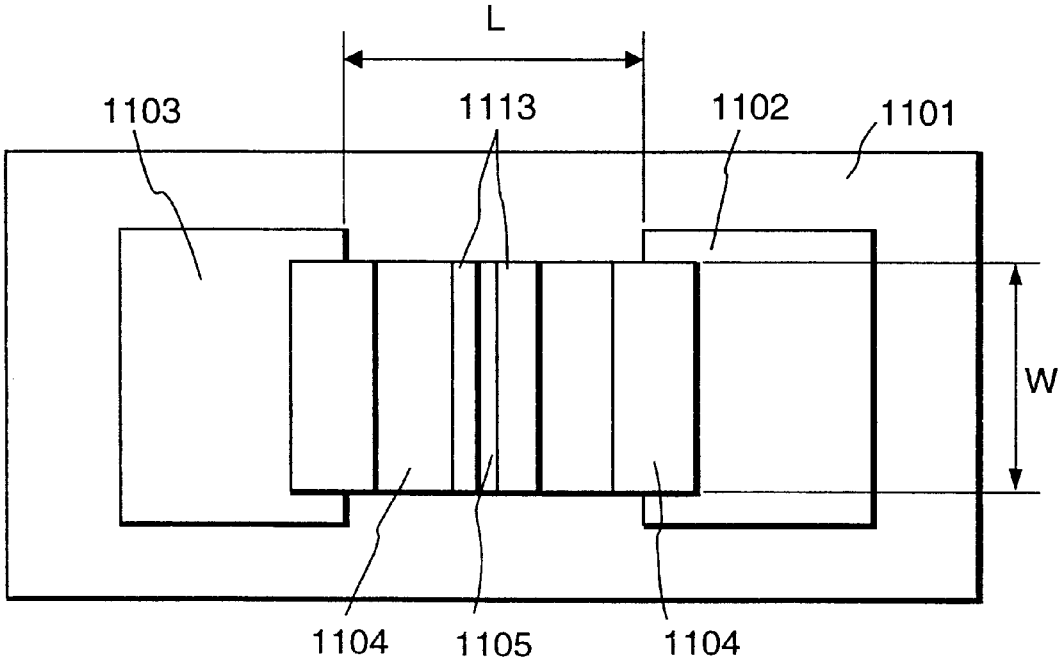
FIGS. 6A and 6B are a plan view and a cross-sectional view, respectively, of a flat surface-conduction emission type electron-emitting device in the embodiment.
Figure 6B:
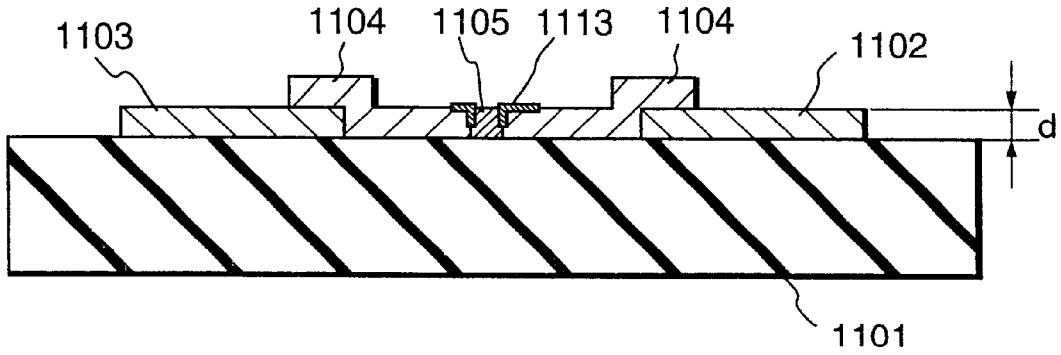

FIG. 3 is a plan view of a multi electron-beam source used in the display panel of FIG. 1. SCE type electron-emitting devices like the one to be described with reference to FIGS. 6A and 6B are arranged on the substrate 1011. These devices are wired in a simple matrix by the row-direction wirings 1013 and the column-direction wirings 1014. At an intersection of the row-direction wiring 1013 and the column-direction wiring 1014, an insulating layer (not shown) is formed to maintain electrical insulation.

Figure 4:
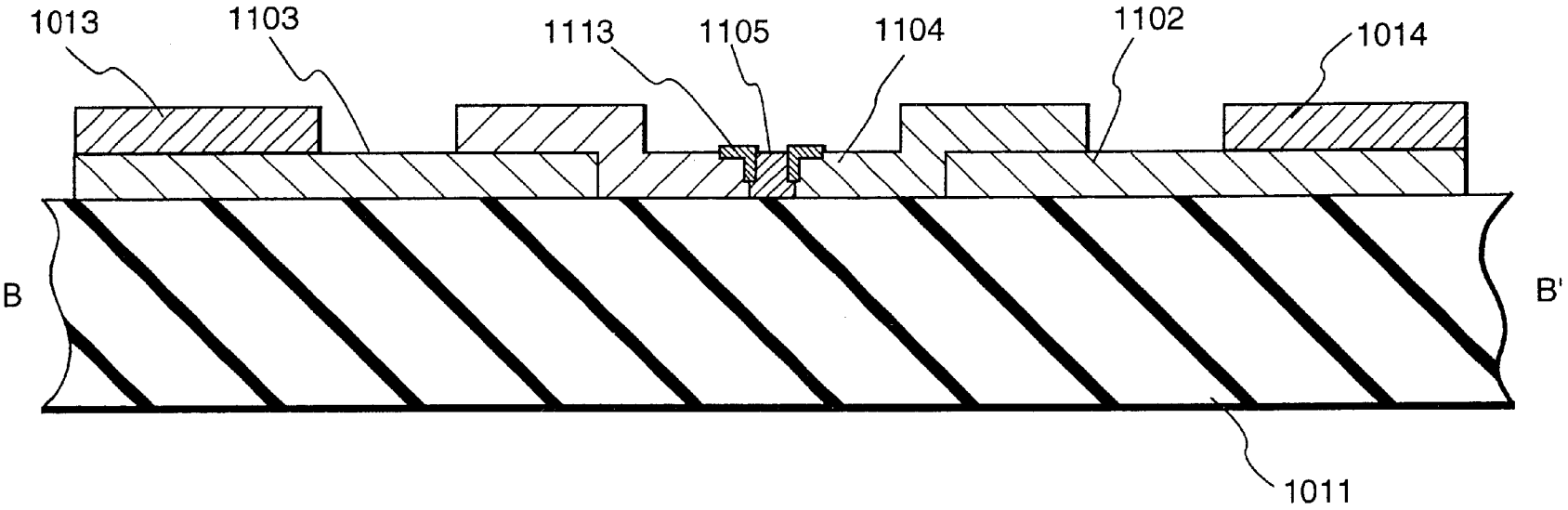
FIG. 4 is a partial cross-sectional view taken along the line B–B' in the substrate of the multi electron-beam source (FIG. 3) used in the embodiment.

FIG. 4 shows a cross-section cut out along the line B–B' in FIG. 3. A multi electron-beam source having this structure is manufactured by forming the row-direction wiring electrodes 1013, the column-direction wiring electrodes 1014, an electrode insulating film (not shown), and device electrodes 1102 and 1103 and conductive thin films 1104 of SCE type electron-emitting devices on the substrate 1011 in advance, and then supplying power to the conductive thin films 1104 via the row-direction wiring electrodes 1013 and the column-direction wiring electrodes 1014 to perform forming processing and activation processing (both of which will be described later).

In this embodiment, the substrate 1011 of the multi electron-beam source is fixed to the rear plate 1015 of the airtight container. However, if the substrate 1011 has sufficient strength, the substrate 1011 of the multi electron-beam source itself may be used as the rear plate of the airtight container.

Figure 5A:
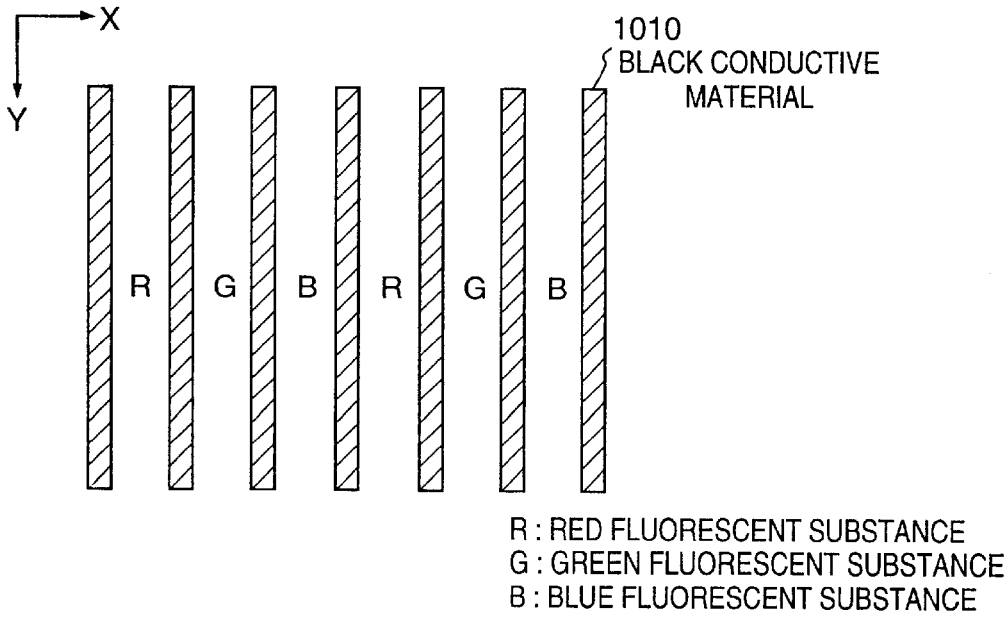
FIGS. 5A and 5B are plan view showing examples of the alignment of fluorescent substances on the face plate of the display panel.

Further, a fluorescent film 1018 is formed under the face plate 1017. As this embodiment is a color display apparatus, the fluorescent film 1018 is colored with red, green and blue three primary color fluorescent substances. The fluorescent substance portions are in stripes as shown in FIG. 5A, and black conductive material 1010 is provided between the stripes. The object of providing the black conductive material 1010 is to prevent shifting of display color even if electron-beam irradiation position is shifted to some extent, to prevent degradation of display contrast by shutting off reflection of external light, to prevent charge-up of the fluorescent film by electron beams, and the like. The black conductive material 1010 mainly comprises graphite, however, any other materials may be employed so far as the above object can be attained.

Figure 5B:
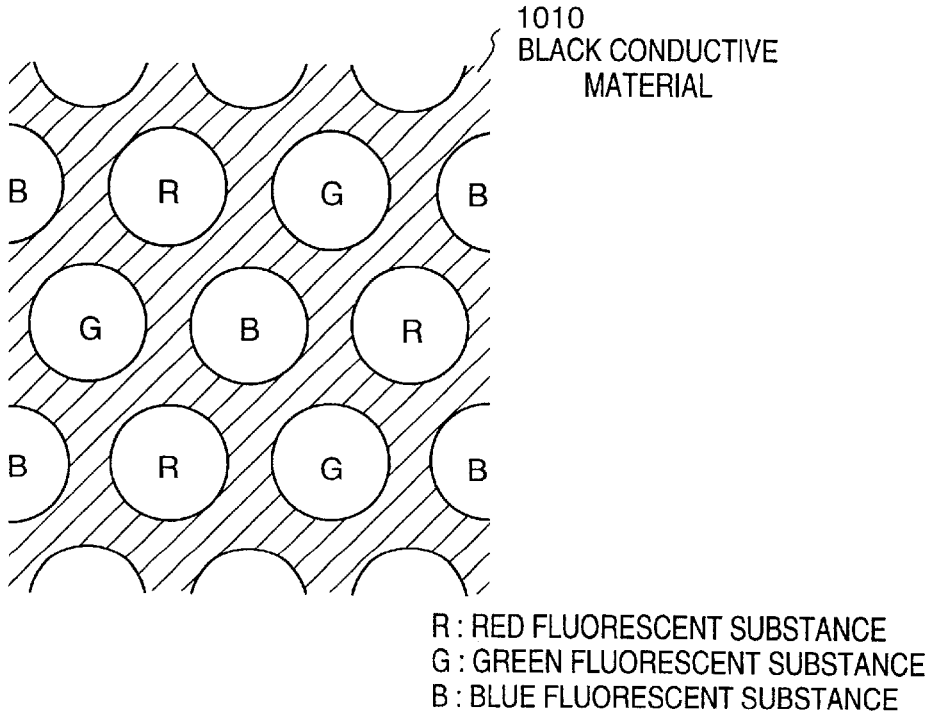

Further, three-primary colors of the fluorescent film is not limited to the stripes as shown in FIG. 5A. For example, delta arrangement as shown in FIG. 5B or any other arrangement may be employed. Note that when a monochrome display panel is formed, a single-color fluorescent substance may be applied to the fluorescent film 1018, and the black conductive material may be omitted.

Further, a metal back 1019, which is well-known in the CRT field, is provided on the rear plate side surface of the fluorescent film 1018. The object of providing the metal back 1019 is to improve light-utilization ratio by mirror-reflecting a part of light emitted from the fluorescent film 1018, to protect the fluorescent film 1018 from collision between negative ions, to use the metal back 1019 as an electrode for applying an electron-beam accelerating voltage, to use the metal back 1019 as a conductive path for electrons which excited the fluorescent film 1018, and the like. The metal back 1019 is formed by, after forming the fluorescent film 1018 on the face plate 1017, smoothing the front surface of the fluorescent film 1018, and vacuum-evaporating Al (aluminum) thereon. Note that in a case where the fluorescent film 1018 comprises fluorescent material for low voltage, the metal back 1019 is not used.

Further, for application of accelerating voltage or improvement of conductivity of the fluorescent film 1018, transparent electrodes made of an ITO material or the like may be provided between the face plate 1017 and the fluorescent film 1018, although the embodiment does not employ such electrodes.

Symbols Dx1 to DxM, Dy1 to DyN and Hv denote electric connection terminals for airtight structure provided for electrical connection of the display panel with an electric circuit (not shown). The terminals Dx1 to DxM are electrically connected to the row-direction wiring 1013 of the multi electron-beam source; Dy1 to DyN, to the column-direction wiring 1014 of the multi electron-beam source; and Hv, to the metal back 1019 of the face plate.

To exhaust air from the inside of the airtight container and make the inside vacuum, after forming the airtight container, an exhaust pipe and a vacuum pump (neither is shown) are connected, and air is exhausted from the airtight container to vacuum at about $10^{-7}$ Torr. Thereafter, the exhaust pipe is sealed. To maintain the vacuum condition inside of the airtight container, a getter film (not shown) is formed at a predetermined position in the airtight container, immediately before/after the sealing. The getter film is a film formed by heating and evaporating getter material mainly including, e.g., Ba, by a heater or high-frequency heating. The suction-attaching operation of the getter film maintains the vacuum condition in the container $1\times10^{-5}$ or $1\times10^{-7}$ Torr.

In the image display apparatus using the above display panel, when a voltage is applied to the cold cathode devices 1012 via the outer terminals Dx1 to DxM and Dy1 to DyN, electrons are emitted by the cold cathode devices 1012. At the same time, a high voltage of several hundreds V to several kV is applied to the metal back 1019 via the outer terminal Hv to accelerate the emitted electrons toward the face plate 1017 to cause them collide with the face plate 1017 and actually the fluorescent film 1018. With this operation, the respective color fluorescent substances forming the fluorescent film 1018 are excited to emit light, thereby displaying an image.

The voltage to be applied to each SCE type electron-emitting device 1012 as a cold cathode device in this embodiment is normally set to about 12 to 16 V; a distance d between the metal back 1019 and the cold cathode device 1012, about 0.1 mm to 8 mm; and the voltage to be applied across the metal back 1019 and the cold cathode device 1012, about 0.1 kV to 10 kV.

The basic structure and manufacturing method of the display panel, and the general description of the image display apparatus using the display panel according to this embodiment have been described.

(Manufacturing Method of Multi Electron-Beam Source)

Next, the manufacturing method of the multi electron-beam source used in the display panel according to the embodiment of this embodiment will be described. As far as the multi electron-beam source used in the image display apparatus is obtained by arranging cold cathode devices in a simple matrix, the material, shape, and manufacturing method of the cold cathode device are not limited. As the cold cathode device, therefore, an SCE type electron-emitting device or an FE type or MIM type cold cathode device can be used. Under circumstances where inexpensive display apparatuses having large display screens are required, an SCE type electron-emitting device, of these cold cathode devices, is especially preferable. More specifically, the electron-emitting characteristic of an FE type device is greatly influenced by the relative positions and shapes of the emitter cone and the gate electrode, and hence a high-precision manufacturing technique is required to manufacture this device. This poses a disadvantageous factor in attaining a large display area and a low manufacturing cost. According to an MIM type device, the thicknesses of the insulating layer and the upper electrode must be decreased and made uniform. This also poses a disadvantageous factor in attaining a large display area and a low manufacturing cost. In contrast to this, an SCE type electron-emitting device can be manufactured by a relatively simple manufacturing method, and hence an increase in display area and a decrease in manufacturing cost can be attained. The present inventors have also found that among the SCE type electron-emitting devices, an electron-beam source where an electron-emitting portion or its peripheral portion comprises a fine particle film is excellent in electron-emitting characteristic and further, it can be easily manufactured. Accordingly, this type of electron-beam source is the most appropriate electron-beam source to be employed in a multi electron-beam source of a high luminance and large-screened image display apparatus. In the display panel of the embodiment, SCE type electron-emitting devices each having an electron-emitting portion or peripheral portion formed from a fine particle film are employed. First, the basic structure, manufacturing method and characteristic of the preferred SCE type electron-emitting device will be described, and the structure of the multi electron-beam source having simple-matrix wired SCE type electron-emitting devices will be described later.

(Preferred Structure and Manufacturing Method of SCE Electron-Emitting Device)

The typical structure of the SCE type electron-emitting device where an electron-emitting portion or its peripheral portion is formed from a fine particle film includes a flat type structure and a step type structure.

(Flat SEC Type Electron-Emitting Device)

First, the structure and manufacturing method of a flat SCE type electron-emitting device will be described.

FIG. 6A is a plan view explaining the structure of the flat SCE type electron-emitting device; and FIG. 6B, a cross-sectional view of the device.

In FIGS. 6A and 6B, numeral 1101 denotes a substrate; 1102 and 1103, device electrodes; 1104, a conductive thin film; 1105, an electron-emitting portion formed by the forming processing; and 1113, a thin film formed by the activation processing. As the substrate 1101, various glass substrates of, e.g., quartz glass and soda-lime glass, various ceramic substrates of, e.g., alumina, or any of those substrates with an insulating layer formed of, e.g., $SiO_2$ thereon can be employed.

The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. The electrode is easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundreds angstroms to hundreds micrometers. Most preferable range for a display apparatus is from several micrometers to tens micrometers. As for electrode thickness d, an appropriate value is selected from a range from hundreds angstroms to several micrometers.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other. One particle has a diameter within a range from several angstroms to thousands angstroms. Preferably, the diameter is within a range from 10 angstroms to 200 angstroms. The thickness of the film is appropriately set in consideration of conditions as follows. That is, condition necessary for electrical connection to the device electrode 1102 or 1103, condition for the forming processing to be described later, condition for setting electric resistance of the fine particle film itself to an appropriate value to be described later etc.

Specifically, the thickness of the film is set in a range from several angstroms to thousands angstroms, more preferably, 10 angstroms to 500 angstroms.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, and carbons. Any of appropriate material(s) is appropriately selected.

As described above, the conductive thin film 1104 is formed with a fine particle film, and the sheet resistance of the film is set to reside within a range from $10^3$ to $10^7$ (Ω/sq).

As it is preferable that the conductive thin film 1104 is electrically connected to the device electrodes 1102 and 1103, they are arranged so as to overlap with each other at one portion. In FIGS. 6A and 6B, the respective parts are overlapped in order of, the substrate, the device electrodes, and the conductive thin film, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than peripheral conductive thin film. The fissure portion is formed by the forming processing to be described later on the conductive thin film 1104. In some cases, particles, having a diameter of several angstroms to hundreds angstroms, are arranged within the fissured portion. As it is difficult to exactly illustrate actual position and shape of the electron-emitting portion, therefore, FIGS. 6A and 6B show the fissured portion schematically.

The thin film 1113, which comprises carbon or carbon compound material, covers the electron-emitting portion 1115 and its peripheral portion. The thin film 1113 is formed by the activation processing to be described later after the forming processing. The thin film 1113 is preferably graphite monocrystalline, graphite polycrystalline, amorphous carbon, or mixture thereof, and its thickness is 500 angstroms or less, more preferably, 300 angstroms or less.

As it is difficult to exactly illustrate actual position or shape of the thin film 1113, FIGS. 6A and 6B show the film schematically. FIG. 6A shows the device where a part of the thin film 1113 is removed.

The preferred basic structure of SCE type electron-emitting device is as described above. In the embodiment, the device has the following constituents.

That is, the substrate 1101 comprises a soda-lime glass, and the device electrodes 1102 and 1103, an Ni thin film. The electrode thickness d is 1000 angstroms and the electrode interval L is 2 micrometers. The main material of the fine particle film is Pd or PdO. The thickness of the fine particle film is about 100 angstroms, and its width W is 100 micrometers.

Next, a method of manufacturing a preferred flat SCE type electron-emitting device will be described.

FIGS. 7A to 7E are cross-sectional views showing the manufacturing processes of the SCE type electron-emitting device. Note that reference numerals are the same as those in FIGS. 6A and 6B.

Figure 7A:
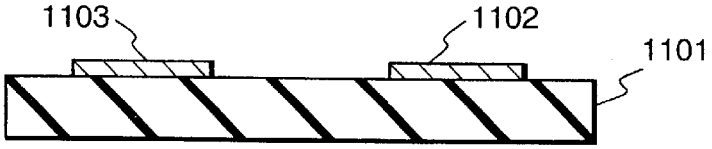
FIGS. 7A to 7E are cross-sectional views respectively showing the steps in manufacturing the flat surface-conduction emission type electron-emitting device.

(1) First, as shown in FIG. 7A, the device electrodes 1102 and 1103 are formed on the substrate 1101. In forming the electrodes 1102 and 1103, first, the substrate 1101 is fully washed with a detergent, pure water and an organic solvent, then, material of the device electrodes is deposited there (as a depositing method, a vacuum film-forming technique such as evaporation and sputtering may be used) Thereafter, patterning using a photolithography etching technique is performed on the deposited electrode material. Thus, the pair of device electrodes (1102 and 1103) shown in FIG. 7A are formed.

Figure 7B:
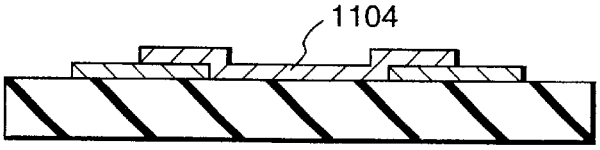

(2) Next, as shown in FIG. 7B, the conductive thin film 1104 is formed. In forming the conductive thin film, first, an organic metal solvent is applied to the substrate in FIG. 7A, then the applied solvent is dried and sintered, thus forming a fine particle film. Thereafter, the fine particle film is patterned, in accordance with the photolithography etching method, into a predetermined shape. The organic metal solvent means a solvent of organic metal compound containing material of minute particles, used for forming the conductive thin film, as main component. More specifically, Pd is used as the main component in this embodiment. In this embodiment, application of organic metal solvent is made by dipping, however, any other method such as a spinner method and spraying method may be employed. As a film-forming method of the conductive thin film made with the minute particles, the application of organic metal solvent used in this embodiment can be replaced with any other method such as a vacuum evaporation method, a sputtering method or a chemical vapor-phase accumulation method.

Figure 7C:
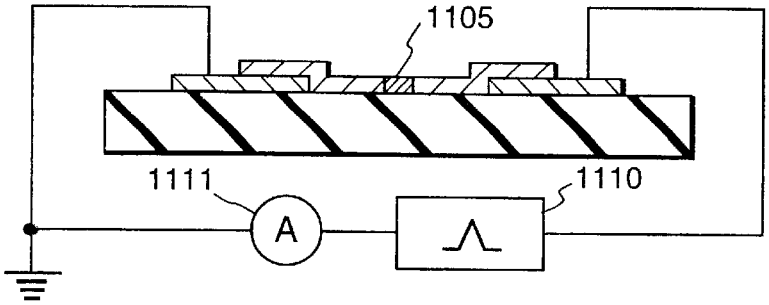

(3) Then, as shown in FIG. 7C, appropriate voltage is applied between the device electrodes 1102 and 1103, from a power source 1110 for the forming processing, then the forming processing is performed, thus forming the electron-emitting portion 1105. The forming processing here is electric energization of a conductive thin film 1104 formed of a fine particle film, to appropriately destroy, deform, or deteriorate a part of the conductive thin film, thus changing the film to have a structure suitable for electron emission. In the conductive thin film made of the fine particle film, the portion changed for electron emission (i.e., electron-emitting portion 1105) has an appropriate fissure in the thin film. Comparing the thin film 1104 having the electron-emitting portion 1105 with the thin film before the forming processing, the electric resistance measured between the device electrodes 1102 and 1103 has greatly increased.

Figure 8:
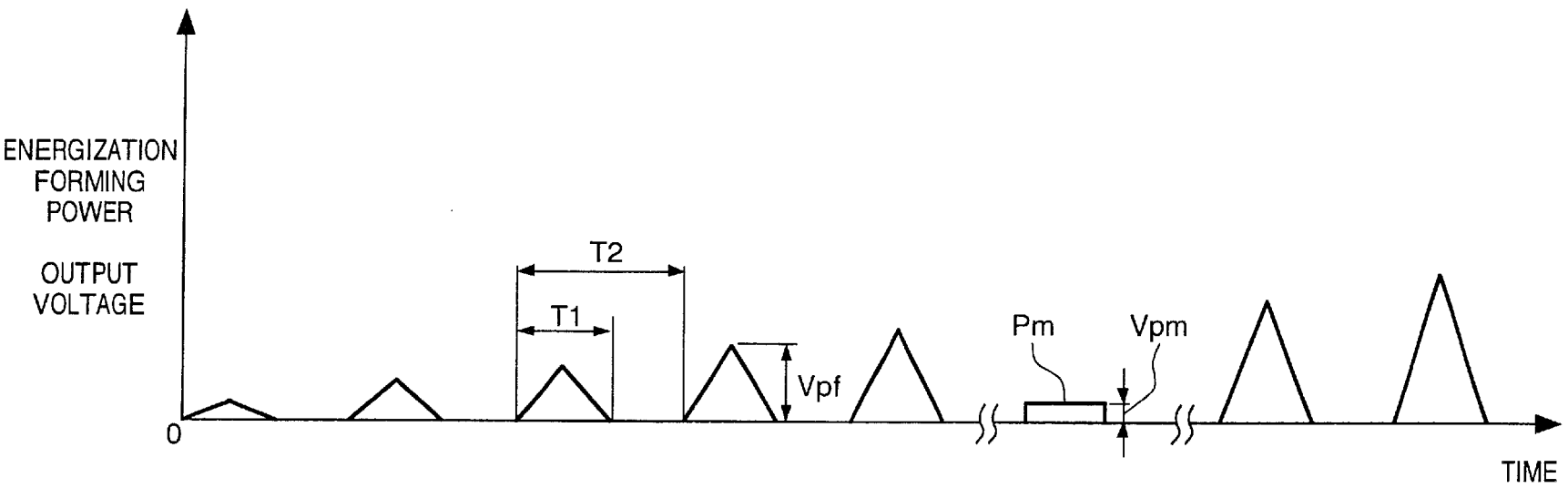
FIG. 8 is a graph showing the waveform of the application voltage in forming processing in the embodiment.

The forming processing will be explained in detail with reference to FIG. 8 showing an example of waveform of appropriate voltage applied from the forming power source 1110. Preferably, in case of forming the conductive thin film 1104 of the fine particle film, a pulse-form voltage is employed. In this embodiment, a triangular-wave pulse having a pulse width T1 is continuously applied at pulse interval of T2, as shown in FIG. 8. Upon application, a wave peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this embodiment, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electric resistance between the device electrodes 1102 and 1103 becomes $1\times10^{6}$ Ω, i.e., the current measured by the galvanometer 1111 upon application of monitor pulse becomes $1\times10^{-7}$ A or less, the electrification of the forming processing is terminated.

Note that the above processing method is preferable to the SCE type electron-emitting device of this embodiment. In case of changing the design of the SCE type electron-emitting device concerning, e.g., the material or thickness of the fine particle film, or the device electrode interval L, the conditions for electrification are preferably changed in accordance with the change of device design.

Figure 7D:
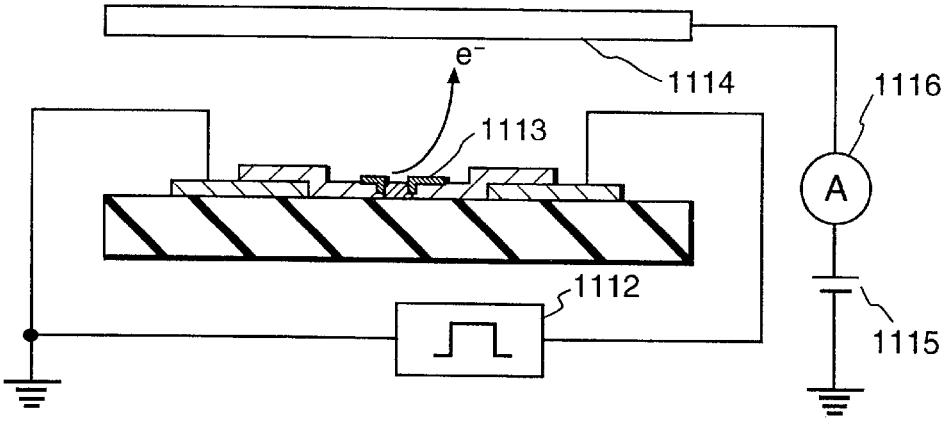

(4) Next, as shown in FIG. 7D, appropriate voltage is applied, from an activation power source 1112, between the device electrodes 1102 and 1103, and the activation processing is performed to improve electron-emitting characteristics. The activation processing here is electrification of the electron-emitting portion 1105, formed by the forming processing, on appropriate condition(s), for depositing carbon or carbon compound around the electron-emitting portion 1105. In FIG. 7D, the deposited material of carbon or carbon compound is shown as material 1113. Comparing the electron-emitting portion 1105 with that before the activation processing, the emission current at the same applied voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 9A:
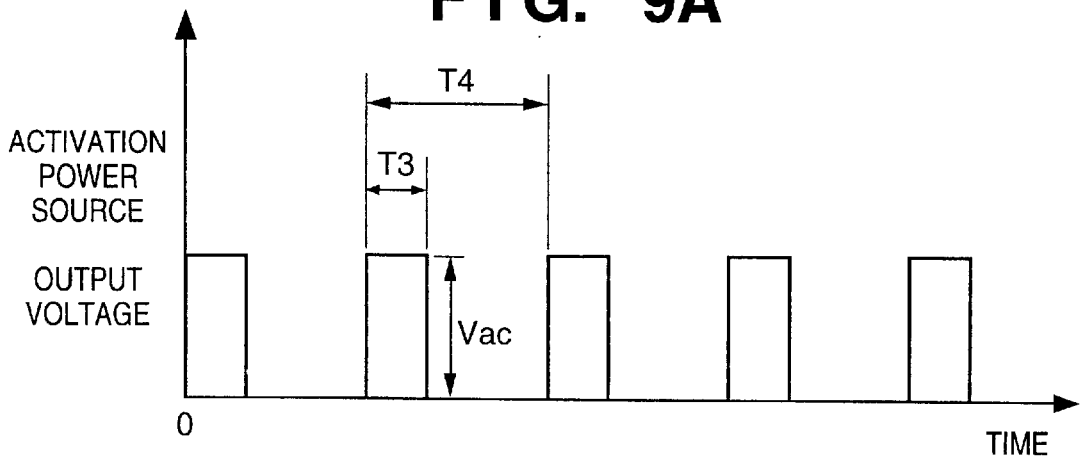
FIGS. 9A and 9B are graphs respectively showing the waveform of the application voltage and a change in emission current Ie in activation processing.

The activation processing will be described in more detail with reference to FIG. 9A showing an example of waveform of appropriate voltage applied from the activation power source 1112.

In this embodiment, a rectangular wave at a predetermined voltage is applied to perform the activation processing. More specifically, a rectangular-wave voltage Vac is set to 14 V; a pulse width T3, to 1 msec; and a pulse interval T4, to 10 msec. Note that the above electrification conditions are preferable for the SCE type electron-emitting device of the embodiment. In a case where the design of the SCE type electron-emitting device is changed, the electrification conditions are preferably changed in accordance with the change of device design.

Figure 9B:
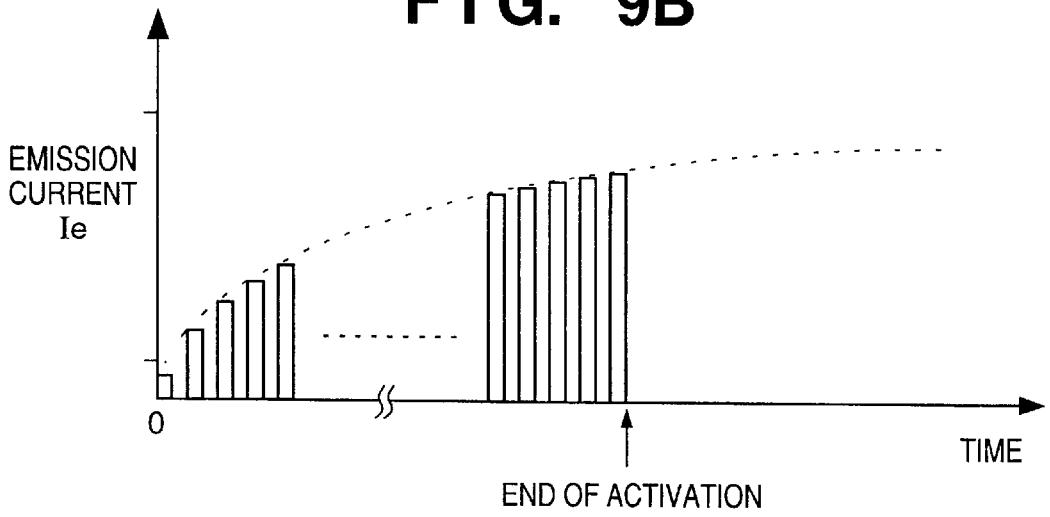

In FIG. 7D, numeral 1114 denotes an anode electrode, connected to a direct-current (DC) high-voltage power source 1115 and a galvanometer 1116, for capturing emission current Ie emitted from the SCE type electron-emitting device. In a case where the substrate 1101 is incorporated into the display panel before the activation processing, the fluorescent surface of the display panel is used as the anode electrode 1114. In this activation processing, while applying voltage from the activation power source 1112, the galvanometer 1116 measures the emission current Ie, thus monitors the progress of activation processing, to control the operation of the activation power source 1112. FIG. 9B shows an example of the emission current Ie measured by the galvanometer 1116 at this time. As is apparent from FIG. 9B, as application of pulse voltage from the activation power source 1112 is started, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the SCE type electron-emitting device of this embodiment. In case of changing the design of the SCE type electron-emitting device, the conditions are preferably changed in accordance with the change of device design.

Figure 7E:
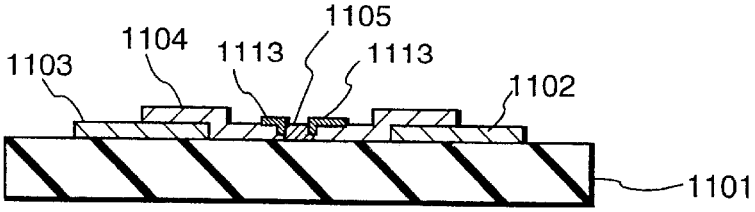

As described above, the SCE type electron-emitting device as shown in FIG. 7E is manufactured.

(Step SCE Type Electron-Emitting Device)

Next, another typical structure of the SCE type electron-emitting device where an electron-emitting portion or its peripheral portion is formed of a fine particle film, i.e., a step SCE type electron-emitting device will be described.

Figure 10:
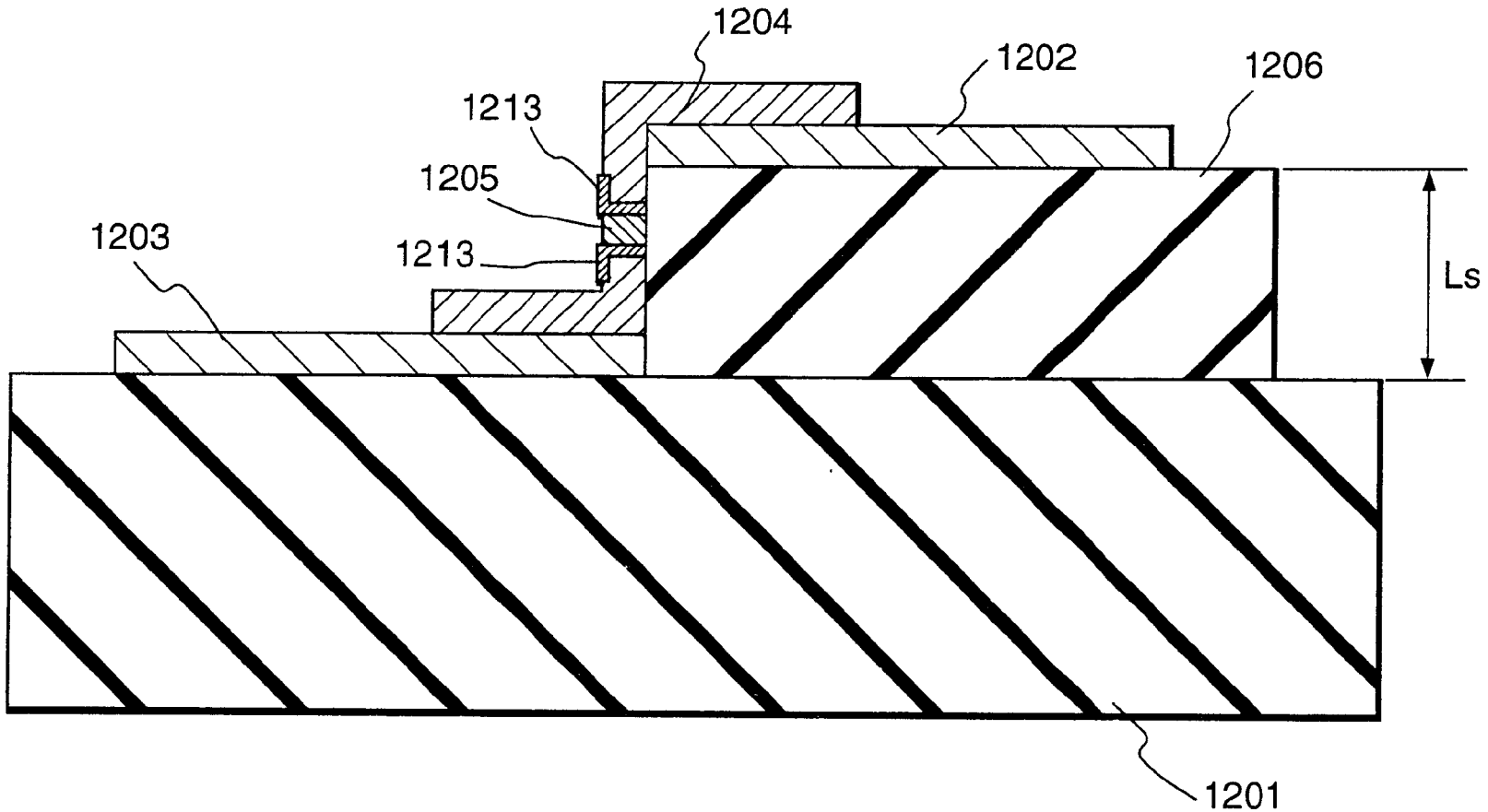
FIG. 10 is a cross-sectional view of a step surface-conduction emission type electron-emitting device used in the embodiment.

FIG. 10 is across-sectional view schematically showing the basic construction of the step SCE type electron-emitting device according to this embodiment. In FIG. 10, numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by the forming processing; and 1213, a thin film formed by the activation processing.

Difference between the step device structure from the above-described flat device structure is that one of the device electrodes (1202 in this embodiment) is provided on the step-forming member 1206 and the conductive thin film 1204 covers the side surface of the step-forming member 1206. The device interval L in FIGS. 6A and 6B is set in this structure as a height difference Ls corresponding to the height of the step-forming member 1206. Note that the substrate 1201, the device electrodes 1202 and 1203, and the conductive thin film 1204 using the fine particle film can comprise the materials given in the explanation of the flat SCE type electron-emitting device. Further, the step-forming member 1206 comprises electrically insulating material such as $SiO_2$.

Next, a method of manufacturing the step SCE type electron-emitting device will be described.

FIGS. 11A to 11F are cross-sectional views showing the manufacturing processes of the step SCE type electron-emitting device. In these figures, reference numerals of the respective parts are the same as those in FIG. 10.

Figure 11A:
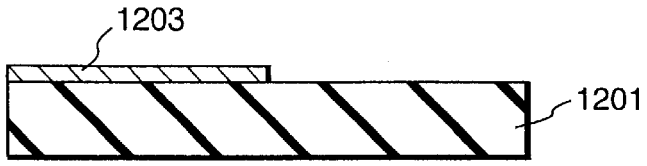
FIGS. 11A to 11F are cross-sectional views respectively showing the steps in manufacturing the step surface-conduction emission type electron-emitting device.

(1) First, as shown in FIG. 11A, the device electrode 1203 is formed on the substrate 1201.

Figure 11B:
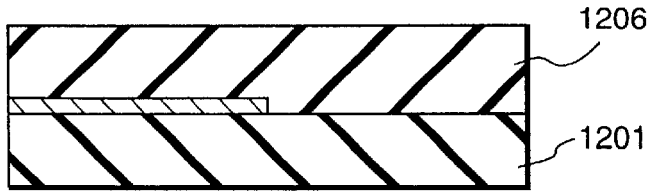

(2) Next, as shown in FIG. 11B, an insulating layer 1206 for forming the step-forming member is deposited. The insulating layer 1206 may be formed by accumulating, e.g., $SiO_2$ by a sputtering method, however, the insulating layer 1206 may be formed by a film-forming method such as a vacuum evaporation method or a printing method.

Figure 11C:
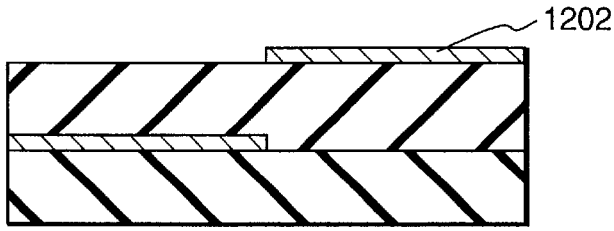

(3) Next, as shown in FIG. 11C, the device electrode 1202 is formed on the insulating layer 1206.

Figure 11D:
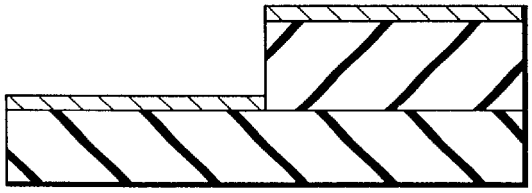

(4) Next, as shown in FIG. 11D, a part of the insulating layer 1206 is removed by using, e.g., an etching method, to expose the device electrode 1203.

Figure 11E:
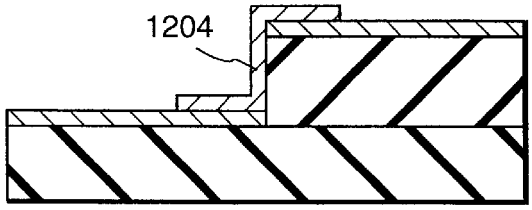

(5) Next, as shown in FIG. 11E, the conductive thin film 1204 using the fine particle film is formed. Upon formation, similar to the above-described flat device structure, a film-forming technique such as an applying method is used.

(6) Next, similar to the flat device structure, the forming processing is performed to form the electron-emitting portion 1205 (the forming processing similar to that explained using FIG. 7C may be performed).

(7) Next, similar to the flat device structure, the activation processing is performed to deposit carbon or carbon compound around the electron-emitting portion (activation processing similar to that explained using FIG. 7D may be performed).

Figure 11F:
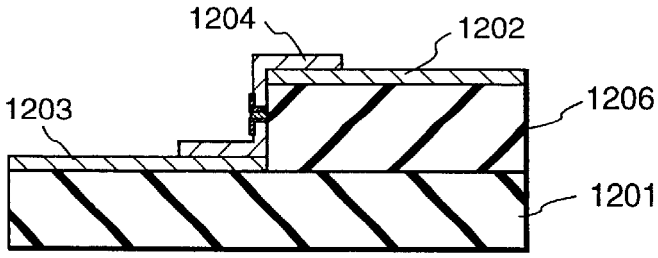

As described above, the step SCE type electron-emitting device shown in FIG. 11F is manufactured.

(Characteristic of SCE Type Electron-Emitting Device Used in Display Apparatus)

The structure and manufacturing method of the flat SCE type electron-emitting device and those of the step SCE type electron-emitting device are as describe d above. Next, the characteristic of the electron-emitting device used in the display apparatus will be described below.

Figure 12:
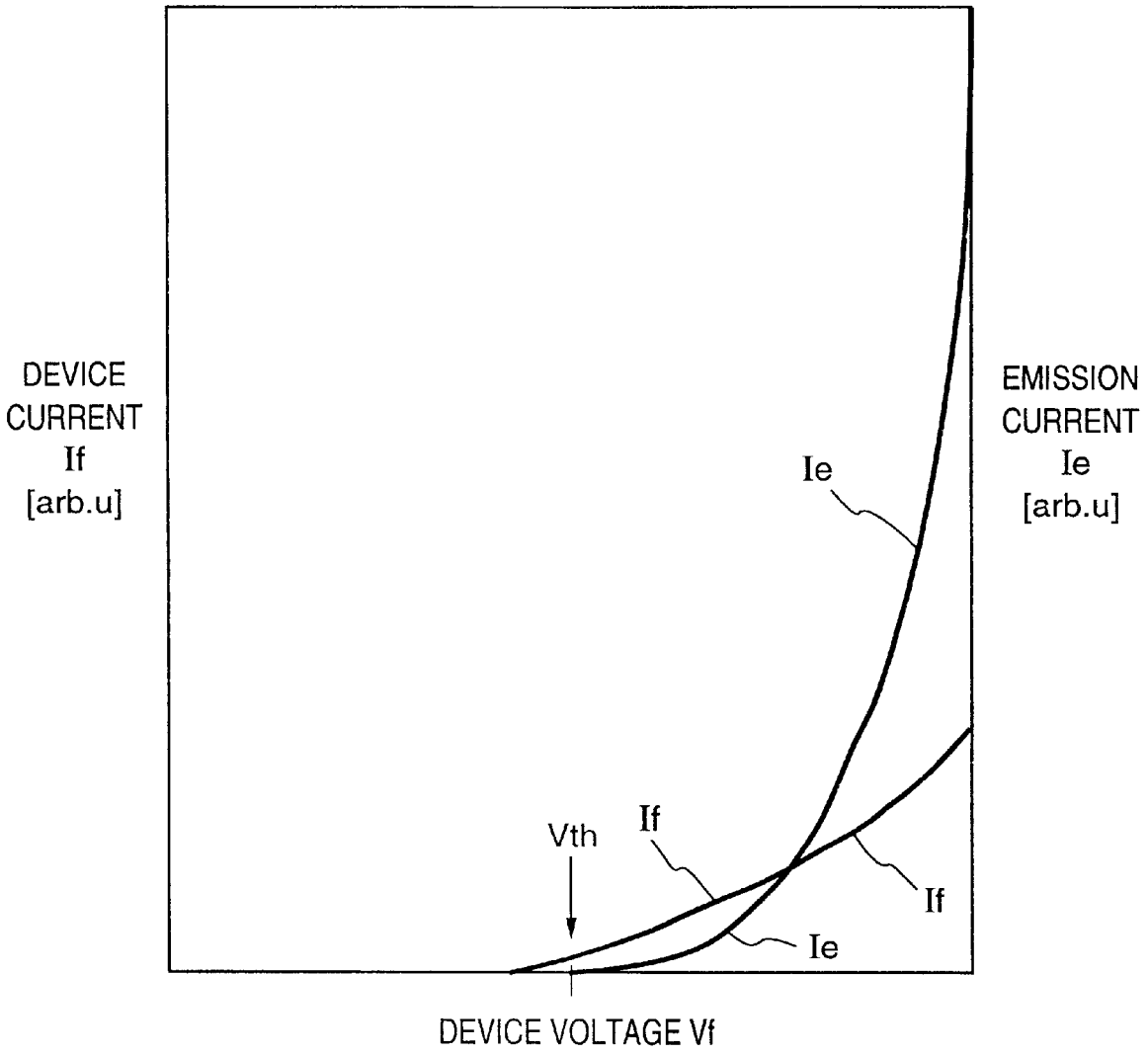
FIG. 12 is a graph showing typical characteristics of the surface-conduction emission type electron-emitting device used in the embodiment.

FIG. 12 shows a typical example of (emission current Ie) to (device voltage (i.e., voltage to be applied to the device) Vf) characteristic and (device current If) to (device application voltage Vf) characteristic of the device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 12 are respectively given in arbitrary units.

Regarding the emission current Ie, the SCE type device used in the image display apparatus of this embodiment has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected.

That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the device voltage Vf.

Third, the emission current Ie is output quickly in response to application of the device voltage Vf. Accordingly, an electrical charge amount of electrons to be emitted from the device can be controlled by changing period of application of the device voltage Vf.

The SCE type electron-emitting device with the above three characteristics is preferably applied to the display apparatus. For example, in a display apparatus having a large number of devices provided corresponding to the number of pixels of a display screen, if the first characteristic is utilized, display by sequential scanning of the display screen is possible. This means that the threshold voltage Vth or greater is appropriately applied to a driven device, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-gradation display.

(Structure of Simple-Matrix Wired Multi Electron-Beam Source)

FIG. 3 is a plan view of a multi electron-beam source where a large number of the above SCE type electron-emitting devices are arranged with the simple-matrix wiring.

There are SCE type electron-emitting devices similar to those shown in FIGS. 6A and 6B on the substrate 1011. These devices are arranged in a simple matrix with the row-direction wiring 1013 and the column-direction wiring 1014. At an intersection of the wirings 1013 and 1014, an insulating layer (not shown) is formed between the wires, to maintain electrical insulation.

(Arrangement (and Driving Method) of Driving Circuit)

Figure 13:
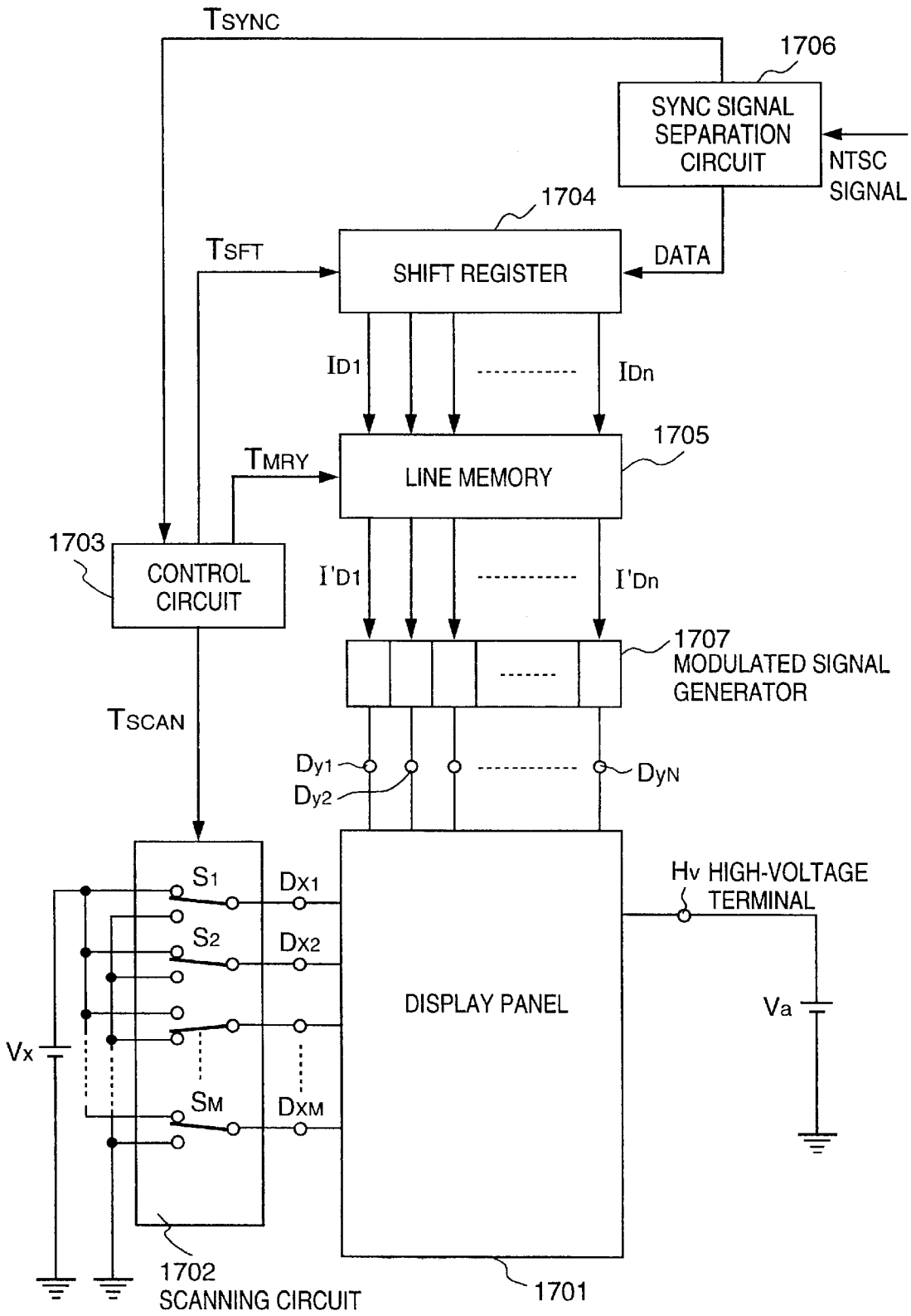
FIG. 13 is a block diagram showing the schematic arrangement of a driving circuit for the image display apparatus of the embodiment.

FIG. 13 is a block diagram showing the schematic arrangement of a driving circuit of a display panel 1701 according to this embodiment that performs television display on the basis of a television signal of the NTSC scheme.

Referring to FIG. 13, the display panel 1701 is equivalent to the above-described display panel in FIG. 1, and manufactured and operates in the same manner described above. A scanning circuit 1702 scans display lines. A control circuit 1703 generate s signals and the like to be input to the scanning circuit 1702. A shift register 1704 shifts data in units of lines. A line memory 1705 inputs 1-line data from the shift register 1704 to a modulated signal generator 1707. A sync signal separation circuit 1706 separates a sync signal from an NTSC signal.

The function of each component in FIG. 13 will be described in detail below.

The display panel 1701 is connected to an external electric circuit through terminals Dx1 to DxM and Dy1 to DyN and a high-voltage terminal Hv. Scanning signals for sequentially driving a multi electron-beam source in the display panel 1701, i.e., cold cathode devices wired in an M×N matrix in units of lines (in units of n devices) are applied to the terminals Dx1 to DxM. Modulated signals for controlling the electron beams output from the N devices corresponding to one line, which are selected by the above scanning signals, in accordance with image signals are applied to the terminals Dy1 to DyN. For example, a DC voltage of 5 kV is applied from a DC voltage source Va to the high-voltage terminal Hv. This voltage is an accelerating voltage for giving energy enough to accelerate electrons output from the multi electron-beam source toward the face plate and excite the fluorescent substances.

The scanning circuit 1702 will be described next. This circuit incorporates M switching elements (denoted by reference symbols S1 to SM in FIG. 13). Each switching element serves to select either an output voltage from a DC voltage source Vx or 0 V (ground level) and is electrically connected to a corresponding one of the terminals Dx1 to DxM of the display panel 1701. The switching elements S1 to SM operate on the basis of a control signal TSCAN output from the control circuit 1703. In practice, this circuit can be easily formed in combination with switching elements such as FETs. The DC voltage source Vx is set on the basis of the characteristics of the electron-emitting device in FIG. 12 to output a constant voltage such that the driving voltage to be applied to a device which is not scanned is set to an electron emission threshold voltage Vth or lower.

The control circuit 1703 serves to match the operations of the respective components with each other to perform proper display on the basis of an externally input image signal. The control circuit 1703 generates control signals TSCAN, TSFT, and TMRY for the respective components on the basis of a sync signal TSYNC sent from the sync signal separation circuit 1706 to be described next. The sync signal separation circuit 1706 is a circuit for separating a sync signal component and a luminance signal component from an externally input NTSC television signal. As is known well, this circuit can be easily formed by using a frequency separation (filter) circuit. The sync signal separated by the sync signal separation circuit 1706 is constituted by vertical and horizontal sync signals, as is known well. In this case, for the sake of descriptive convenience, the sync signal is shown as the signal TSYNC. The luminance signal component of an image, which is separated from the television signal, is expressed as a signal DATA for the sake of descriptive convenience. This signal is input to the shift register 1704.

The shift register 1704 performs serial/parallel conversion of the signal DATA, which is serially input in a time-series manner, in units of lines of an image. The shift register 1704 operates on the basis of the control signal TSFT sent from the control circuit 1703. In other words, the control signal TSFT is a shift clock for the shift register 1704. One-line data (corresponding to driving data for n electron-emitting devices) obtained by serial/parallel conversion is output as N signals Id1 to IdN from the shift register 1704.

The line memory 1705 is a memory for storing 1-line data for a required period of time. The line memory 1705 properly stores the contents of the signals Id1 to IdN in accordance with the control signal TMRY sent from the control circuit 1703. The stored contents are output as data I'd1 to I'dN to be input to a modulated signal generator 1707.

The modulated signal generator 1707 is a signal source for performing proper driving/modulation with respect to each electron-emitting device 1012 in accordance with each of the image data I'd1 to I'dN. Output signals from the modulated signal generator 1707 are applied to the electron-emitting devices 1012 in the display panel 1701 through the terminals Dy1 to DyN.

The SCE type electron-emitting device according to this embodiment of the present invention has the following basic characteristics with respect to an emission current Ie, as described above with reference to FIG. 12. A clear threshold voltage Vth (8 V in the SCE type electron-emitting device of an embodiment described later) is set for electron emission. Each device emits electrons only when a voltage equal to or higher than the threshold voltage Vth is applied. In addition, the emission current Ie changes with a change in voltage equal to or higher than the electron emission threshold voltage Vth, as shown in the graph of FIG. 12. Obviously, when a pulse-like voltage is to be applied to this device, no electrons are emitted if the voltage is lower than, e.g., the electron emission threshold voltage Vth. If, however, the voltage is equal to or higher than the electron emission threshold voltage Vth, the SCE type electron-emitting device emits an electron beam. In this case, the intensity of the output electron beam can be controlled by changing a peak value Vm of the pulse. In addition, the total amount of electron beam charges output from the electron-beam source can be controlled by changing a width Pw of the pulse.

As a scheme of modulating an output from each electron-emitting device in accordance with an input signal, therefore, a voltage modulation scheme, a pulse width modulation scheme, or the like can be used. In executing the voltage modulation scheme, a voltage modulation circuit for generating a voltage pulse with a constant length and modulating the peak value of the pulse in accordance with input data can be used as the modulated signal generator 1707. In executing the pulse width modulation scheme, a pulse width modulation circuit for generating a voltage pulse with a constant peak value and modulating the width of the voltage pulse in accordance with input data can be used as the modulated signal generator 1707.

The shift register 1704 and the line memory 1705 may be of the digital signal type or the analog signal type. That is, it suffices if an image signal is serial/parallel-converted and stored at predetermined speeds.

When the above components are of the digital signal type, the output signal DATA from the sync signal separation circuit 1706 must be converted into a digital signal. For this purpose, an A/D converter may be connected to the output terminal of the sync signal separation circuit 1706. Slightly different circuits are used for the modulated signal generator depending on whether the line memory 1705 outputs a digital or analog signal. More specifically, in the case of the voltage modulation scheme using a digital signal, for example, a D/A conversion circuit is used as the modulated signal generator 1707, and an amplification circuit and the like are added thereto, as needed. In the case of the pulse width modulation scheme, for example, a circuit constituted by a combination of a high-speed oscillator, a counter for counting the wave number of the signal output from the oscillator, and a comparator for comparing the output value from the counter with the output value from the memory is used as the modulated signal generator 1707. This circuit may include, as needed, an amplifier for amplifying the voltage of the pulse-width-modulated signal output from the comparator to the driving voltage for the electron-emitting device.

In the case of the voltage modulation scheme using an analog signal, for example, an amplification circuit using an operational amplifier and the like may be used as the modulated signal generator 1707, and a shift level circuit and the like may be added thereto, as needed. In the case of the pulse width modulation scheme, for example, a voltage-controlled oscillator (VCO) can be used, and an amplifier for amplifying an output from the oscillator to the driving voltage for the electron-emitting device can be added thereto, as needed.

In the image display apparatus having one of the above arrangements to which this embodiment can be applied, when voltages are applied to the respective electron-emitting devices through the outer terminals Dx1 to DxM and Dy1 to DyN, electrons are emitted. A high voltage is applied to the metal back 1019 or the transparent electrode (not shown) through the high-voltage terminal Hv to accelerate the electron beams. The accelerated electrons collide with the fluorescent film 1018 to cause it to emit light, thereby forming an image.

The above arrangement of the image display apparatus is an example of an image forming apparatus to which the present invention can be applied. Various changes and modifications of this arrangement can be made within the spirit and scope of the present invention. Although a signal based on the NTSC scheme is used as an input signal, the input signal is not limited to this. For example, the PAL scheme and the SECAM scheme can be used. In addition, a TV signal (high-definition TV such as MUSE) scheme using a larger number of scanning lines than these schemes can be used.

(Positional Relationship between Cold Cathode Device and Spacer)

In this embodiment, the position of the cold cathode device is adjusted in accordance with the distance to the spacer in order to compensate a change in electron beam orbit under the influence of the charge-up of the spacer.

The relationship between the positions of the cold cathode device and the spacer and the bending of the electron beam will be explained with reference to FIGS. 14A to 14C.

Figure 14A:
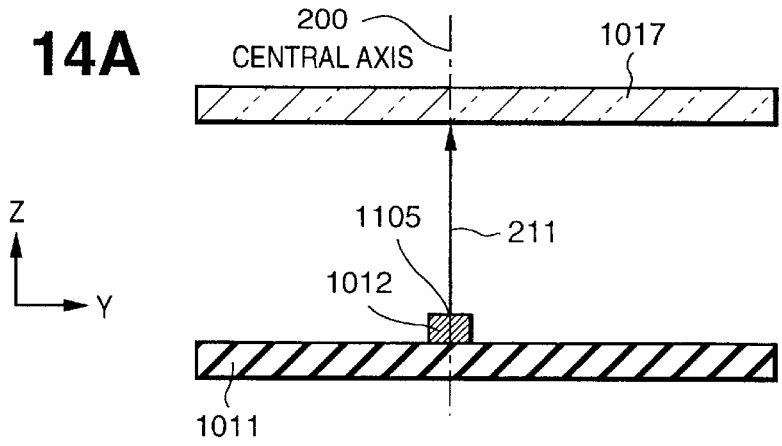
FIGS. 14A to 14C are views for explaining the state wherein an electron emitted by an electron-emitting device collides with the face plate.
Figure 14B:
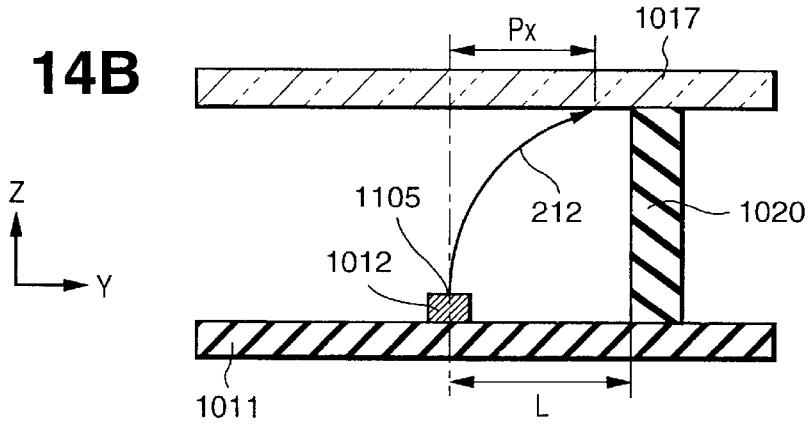
Figure 14C:
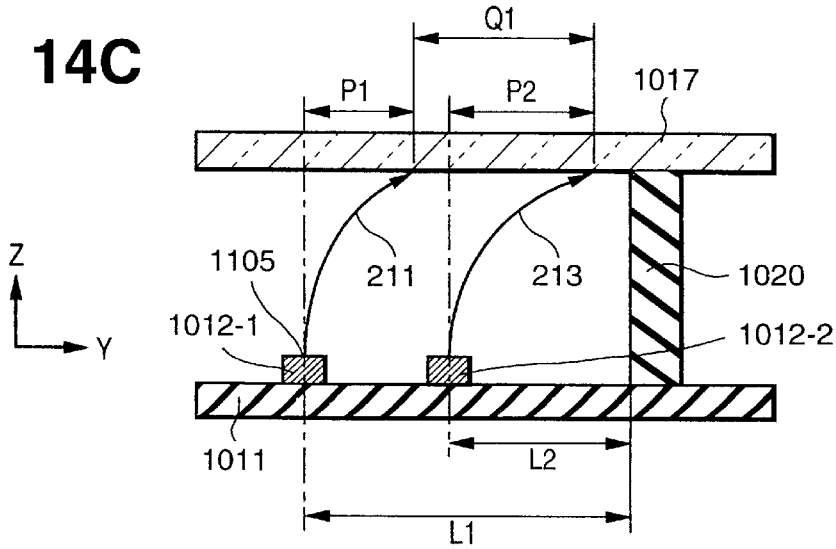

FIGS. 14A to 14C are cross-sectional views taken along the line A–A' in FIG. 1 that show the basic structure of the image forming apparatus according to this embodiment of the present invention.

The face plate 1017 includes fluorescent substances and a metal back (neither is shown). Numeral 1011 denotes an electron source substrate; 1020, a spacer; 1012, a cold cathode device; 1105, an electron-emitting portion; and 211 to 213, electron orbits.

FIG. 14A shows the orbit of an electron emitted by a cold cathode device sufficiently apart from the spacer 1020. In this case, since the electron emitted by the device 1012 is free from any influence of the charge-up of the spacer 1020, the electron is deflected by a predetermined amount toward the positive electrode of the device electrode to reach the face plate 1017.

To the contrary, as shown in FIG. 14B, an electron emitted by a cold cathode device near the spacer 1020 is influenced by the positive charge-up of the spacer 1020, and the orbit of the electron emitted by the device 1020 is bent in the direction close to the spacer 1020. Letting L be the distance from the device 1012 to the spacer 1020, and Px be the distance to the electron landing position on the face plate 1017 that corresponds to the shift amount of the electron orbit, the distance Px increases with a decrease in distance L from the spacer 1020 to the device 1012, and decreases with an increase in distance L from the device 1012 to the spacer 1020.

The relationship between the distance L to the device and an electron landing position (L-Px) can be obtained by measuring in advance the distance Px corresponding to the driving conditions (accelerating voltage Va and device voltage Vf) for each device and the electron accelerating distance (spacer height) d, and the distance L from the spacer 1020.

Given an L, the relationship between the shift amount Px, the accelerating voltage Va, and the accelerating distance (spacer height) d is given by equation (1):

(Equation 1)

$$Px=A\times SQRT\{(1/Va)\times d)\}$$

where

A : proportional constant obtained experimentally

SQRT($\alpha$): square root of $\alpha$

From this, even if an electron is emitted by a device near the spacer 1020, a desired position on the face plate 1017 can be irradiated with the electron by using the driving conditions (Va and Vf), the relationship (L-Px) expressed by the shift Px for a certain spacer height d and the distance L between the device and the spacer, and equation (1) above. Further, if the position of the device near the spacer is adjusted in advance using this relationship, even an electron emitted by the device near the spacer 1020 can be made to collide with the face plate at a predetermined interval Q1 (=(L1−P1)−(L2−P2)), as shown in FIG. 14C.

By employing this structure, an image forming apparatus capable of preventing a decrease in luminance around the spacer 1020 caused when the spacer 1020 shields electrons emitted near the spacer 1020, and image distortion near the spacer caused when electrons fail to reach desired fluorescent substances can be provided.

The shape of the spacer 1020 is not limited to a rectangle in this embodiment. The same effects as those described above can be obtained even by, e.g., a columnar or spherical spacer.

The present invention will be described in more detail below with reference to embodiments.

In the following embodiments, a multi electron-beam source is prepared by wiring N×M (N=3,072, M=1,024) SCE type electron-emitting devices each having an electron-emitting portion on a conductive fine particle film between electrodes, by M row-direction wirings and N column-direction wirings in a matrix (see FIGS. 1 and 3).

An appropriate number of spacers are arranged to obtain the atmospheric pressure resistance of the image forming apparatus.

(First Embodiment)

The first embodiment will be described with reference to FIGS. 15, 16A, and 16B. The same reference numerals as in FIGS. 1 and 14A to 14C denote the same parts, and a description thereof will be omitted.

Numeral 1012-1 to 1012-10 denote cold cathode devices; and 2112-1 to 2112-10, orbits of electrons emitted by corresponding cold cathode devices.

Figure 16A:
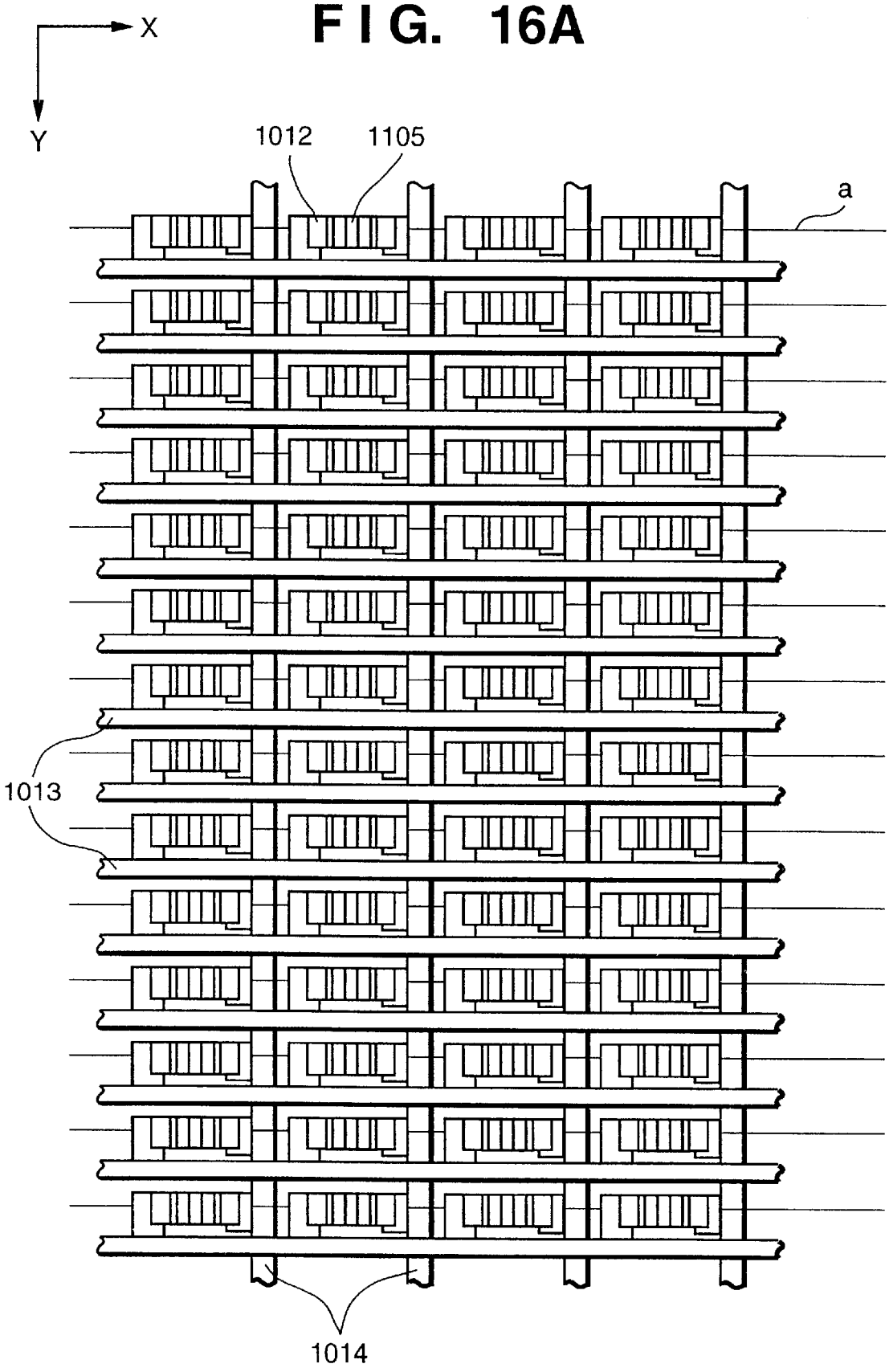
Figure 16B:
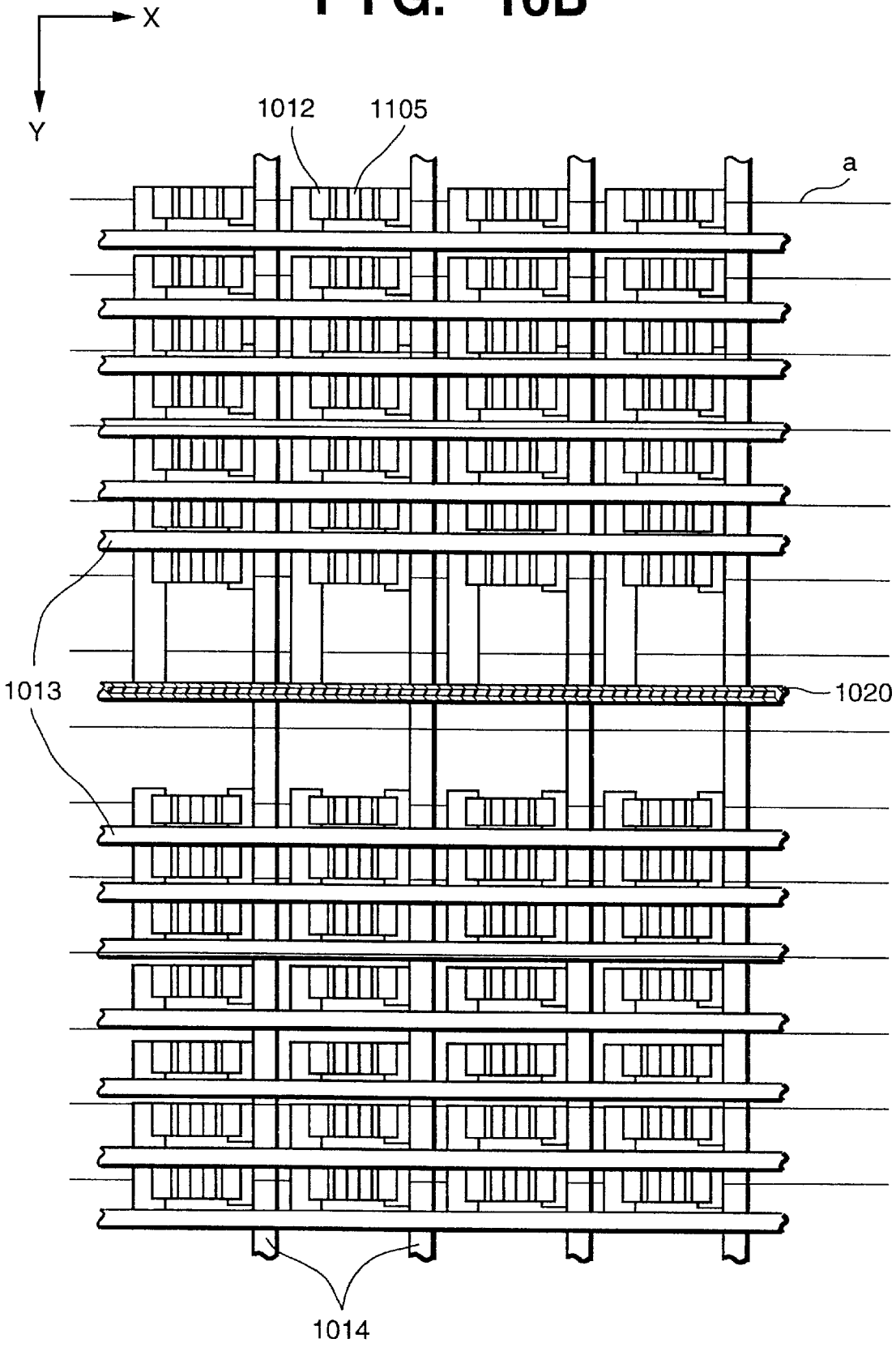
Figure 17:
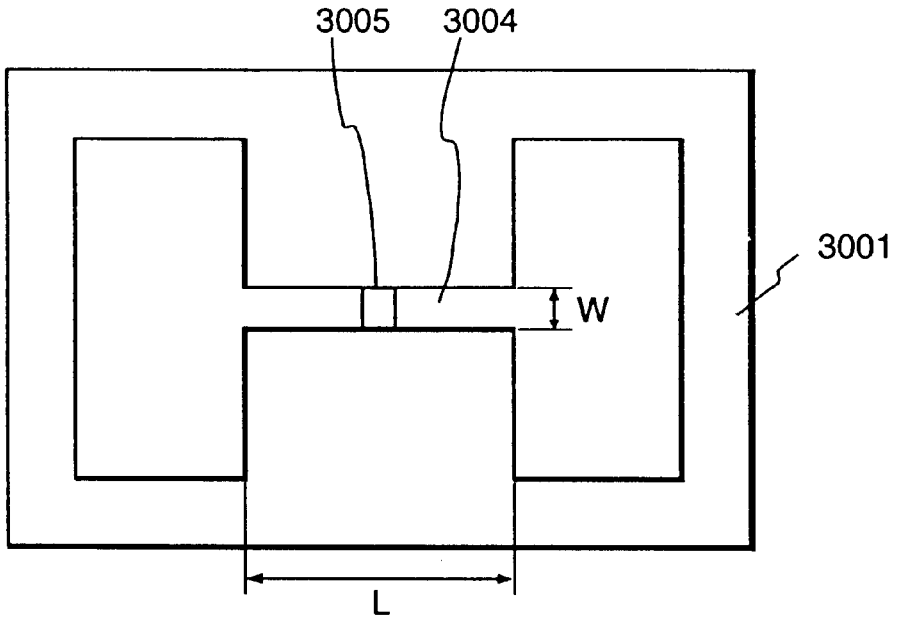
FIG. 17 PRIOR ART
FIG. 17 is a view showing an example of a known surface-conduction emission type electron-emitting device.
Figure 18:
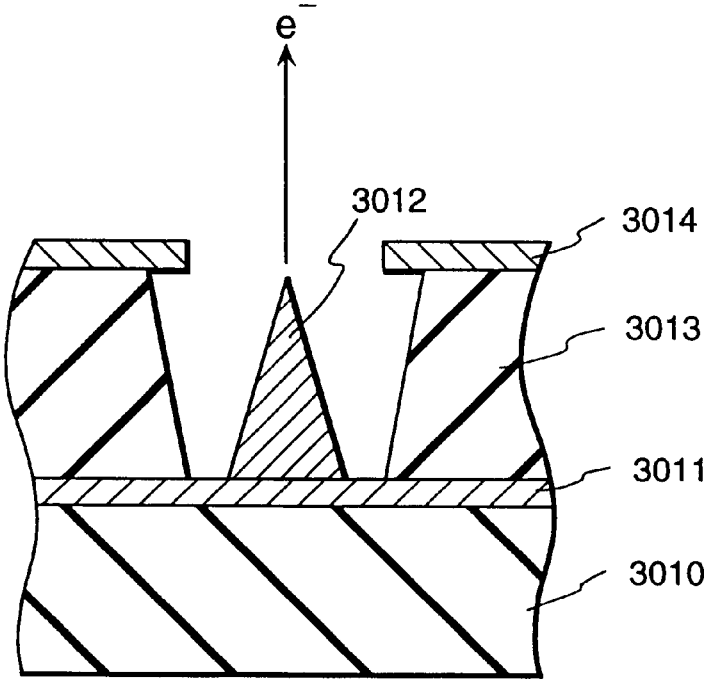
FIG. 18 PRIOR ART
FIG. 18 is a view showing an example of a known FE type device.
Figure 19:
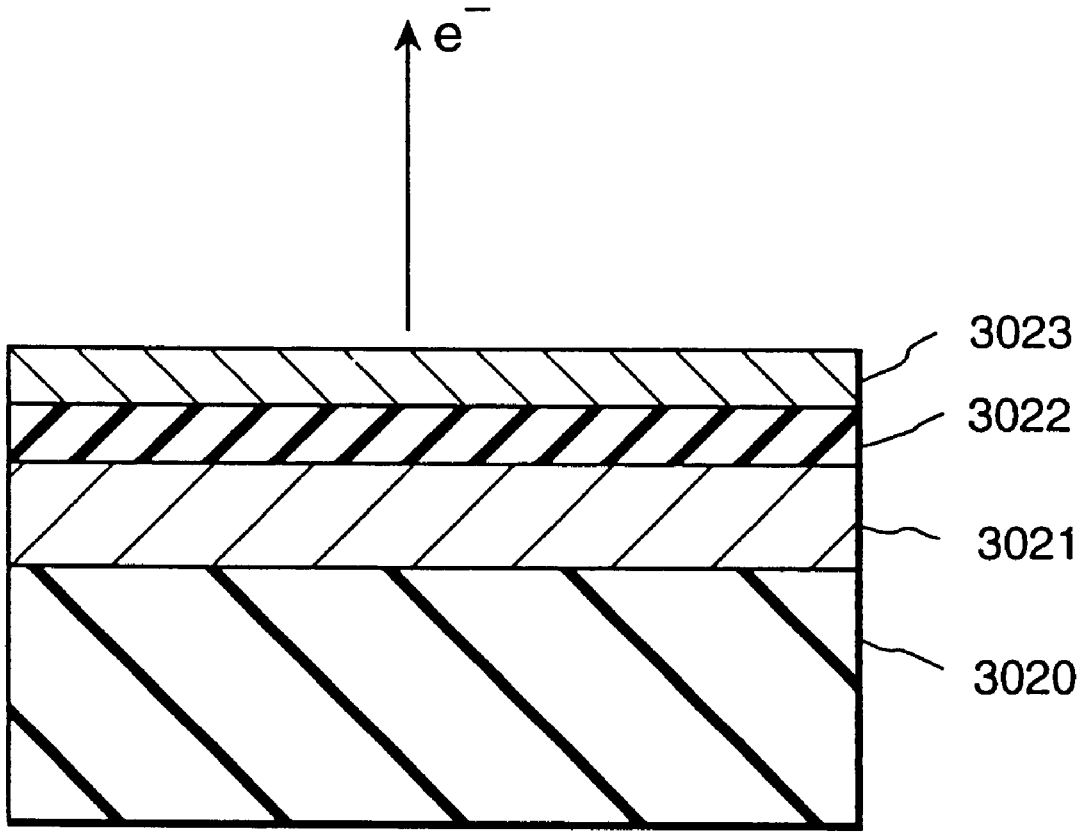
FIG. 19 PRIOR ART
FIG. 19 is a view showing an example of a known MIM type device.
Figure 20:
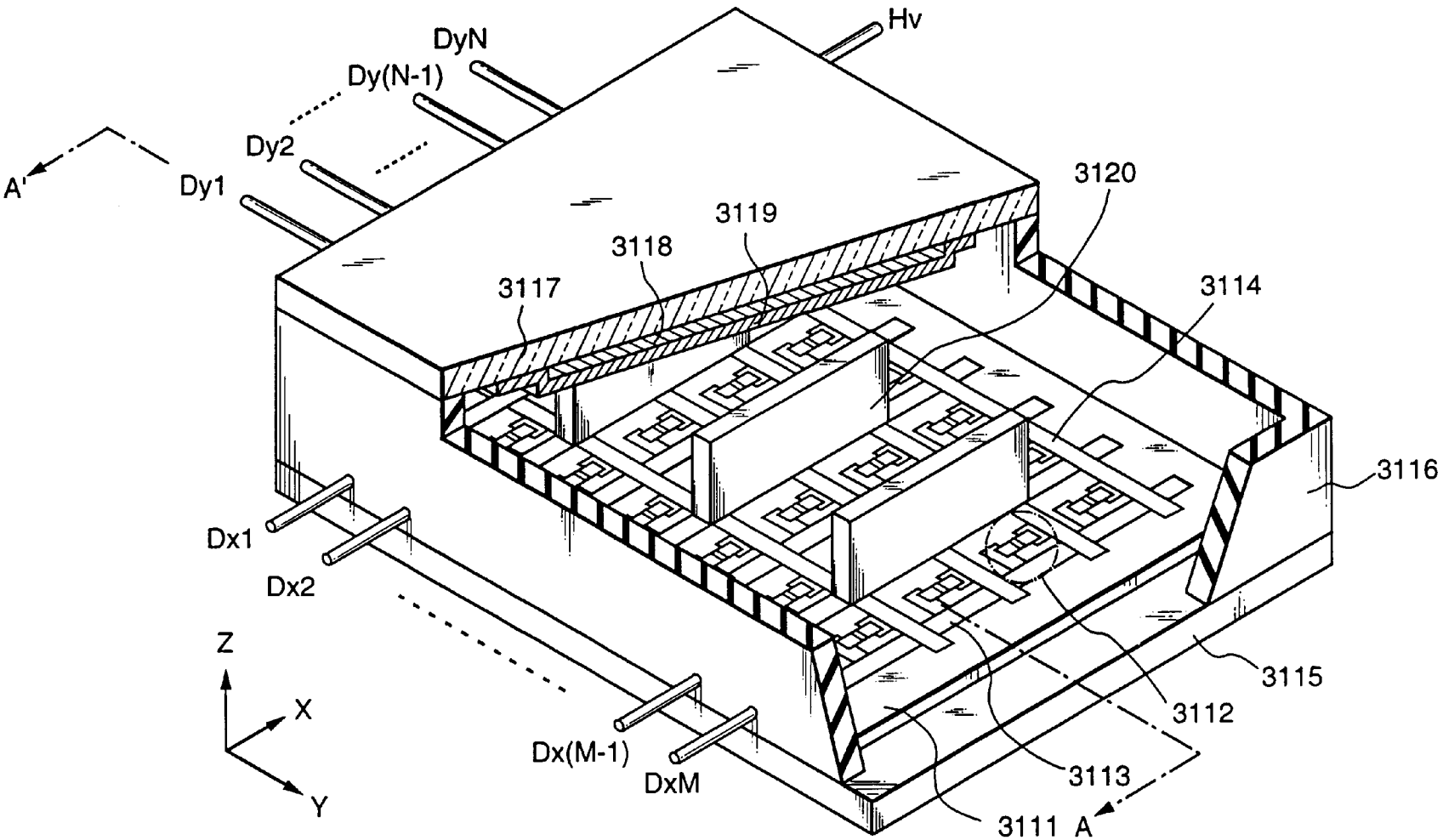
FIG. 20 PRIOR ART
FIG. 20 is a partially cutaway perspective view of the display panel of the image display apparatus.
Figure 21:
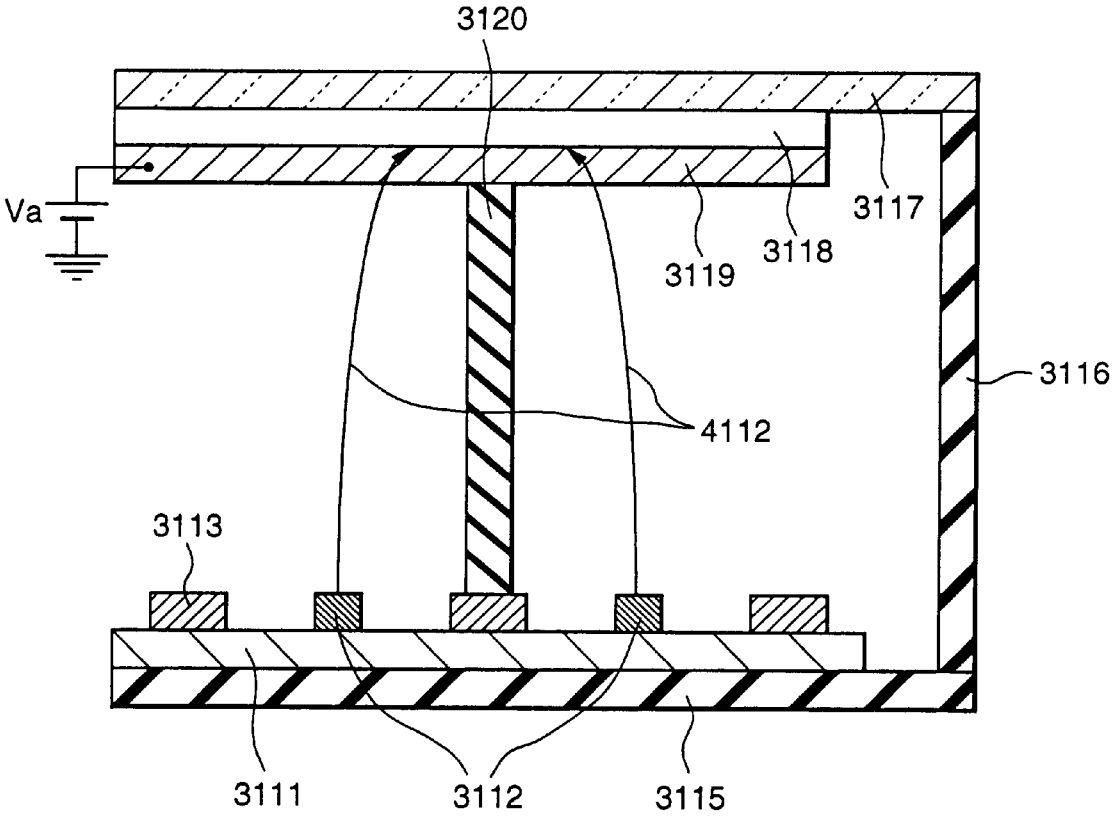
FIG. 21 PRIOR ART
FIG. 21 is a view for explaining the problem to be solved by the present invention.

FIGS. 16A and 16B are views for explaining the arrangement of the cold cathode devices 1012 on a substrate 1011 and the positional relationship with a spacer 1020. FIG. 16A is a view showing the positions of the devices in a region where no spacer is arranged. FIG. 16B is a view showing the positions of the devices in a region where the spacer is arranged. Referring to FIGS. 16A and 16B, numeral 1013 denotes a row-direction wiring; 1014, a column-direction wiring; and 1020, a spacer. Symbol a denotes positions where beam spots are formed parallel when electrons are incident on fluorescent substances to emit light. At an intersection of the row-direction wiring electrode 1013 and the column-direction wiring electrode 1014, an insulating layer (not shown) is formed between the electrodes to maintain electrical insulation.

In the region of FIG. 16A where no spacer is formed, electron-emitting device portions are arranged at the same pitch, and the positions a where beam spots are formed parallel are located almost immediately above the centers of the devices. On the other hand, in the region shown in FIG. 16B where the spacer is arranged, electron-emitting device portions near the spacer are formed at positions spaced apart from the spacer with respect to the positions where beam spots are formed. At the electron-emitting portions arranged parallel to the row-direction wiring electrodes 1013, when the positions of a plurality of electron-emitting portions are shifted from the lines a where beam spots are formed, the shift amounts of the electron-emitting device portions from the line positions where beam spots are formed are set such that the shift amounts of electron-emitting portions near the spacer become larger.

In the first embodiment, to correct a change in electron orbit caused by the charge-up of the spacer 1020 by using the distance between the cold cathode device 1020 and the spacer 1020 as a parameter, the devices 1012 are arranged such that the direction to emit an electron by the cold cathode device 1020 is almost parallel (x-axis direction) to the longitudinal direction of the spacer 1020. In this case, the devices were arranged at an interval of 700 μm, and the thickness of the spacer was about 200 μm.

A distance d between the inner surface of a face plate 1017 and the inner surface of the rear plate (substrate) 1011 was set to 4 mm, and the accelerating voltage Va was set to 3 kV. A voltage of −8V was applied to the row-direction wiring 1013, a voltage of +8 V was applied to the column-direction wiring 1014, and a driving voltage (device voltage) of 16 V was applied to the cold cathode devices 1012-1 to 1012-10.

Figure 15:
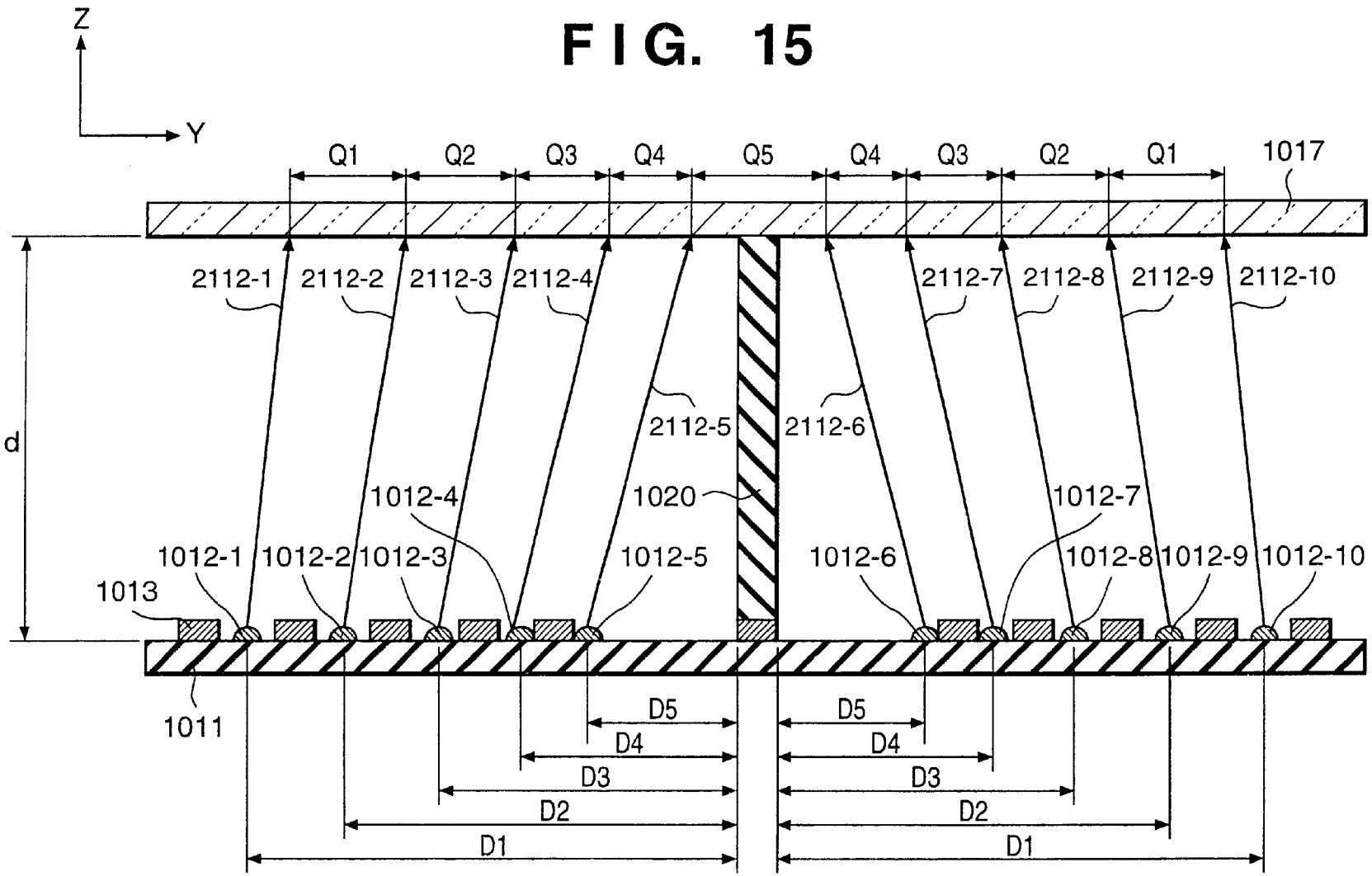
FIG. 15 is a cross-sectional view of the display panel in the embodiment of the present invention.

As shown in FIG. 15, distances D1, D2, D3, D4, and D5 from the spacer 1020 to the respective devices were properly adjusted to about 3,100 μm, about 2,600 μm, about 2,000 μm, about 1,500 μm, and about 1,200 μm. Then, spot intervals Q1, Q2, Q3, Q4, and Q5 on the face plate 1017 between electrons emitted by these devices became almost the same as about 700 μm. In this manner, by properly adjusting the distance (position) L between the spacer 1020 and the device, electrons emitted by even devices near the spacer 1020 can form electron spots on the face plate at almost the same interval. An image free from image distortion caused by the charge-up of the spacer 1020 and a decrease in luminance can be formed even near the spacer 1020.

A comparative example wherein all devices are arranged at the same interval of about 700 μm (D5=250 μm, D4=950 μm, D3=1,650 μm, D2=2,350 μm, and D1=3,050 μm) regardless of the position of the spacer 1020 will be described.

As shown in FIG. 15, when the distances D1, D2, D3, D4, and D5 from the spacer 1020 to the respective devices are set to the above values, and the devices 1012-1 to 1012-10 are arranged at the same interval, electrons emitted by the respective devices are greatly deflected, toward the spacer 1020. In this case, the electron spot interval Q5 which should be formed near the spacer 1020 could not be visually checked. As for a spot formed by electrons emitted by the second closest device, some of the electrons could not reach fluorescent substance portions, and a deformed spot was observed. The luminance decreased near the spacer 1020. This is because some of electrons emitted by the devices 1012-4, 1012-5, 1012-6, and 1012-7 in FIG. 15 were drawn by the spacer 1020 and could not reach the face plate 1017. Also, the orbits of electrons emitted by devices other than the devices 1012-4, 1012-5, 1012-6, and 1012-7 were greatly bent by the charge-up of the spacer 1020. The intervals Q1, Q2, Q3, and Q4 of electron spots formed on the face plate 1017 were about 800 μm, about 900 μm, about 950 μm, and about 1,300 μm, respectively. As a result, the spot interval became nonuniform, and a decrease in luminance and image distortion were observed near the spacer 1020.

In the first embodiment, the device pitches are set in the above-described manner in order to arrange, at an interval of 700 μm, positions where the image forming member is irradiated with electrons emitted by the respective electron-emitting devices. The spacer is set to make its center coincide with the center between electron-emitting devices adjacent to each other through the spacer. Therefore, electrons emitted by the devices closest to the spacer reach positions spaced apart from the side surfaces of the spacer by about 250 μm. Electrons emitted by the second closest devices reach positions spaced apart from the side surfaces of the spacer by about 950 μm. Electrons emitted by the third closest devices reach positions spaced apart from the side surfaces of the spacer by about 1,650 μm. Electrons emitted by the fourth closest devices reach positions spaced apart from the side surfaces of the spacer by about 2,350 μm. Electrons emitted by the fifth closest devices reach positions spaced apart from the side surfaces of the spacer by about 3,050 μm. Electrons emitted by subsequent electron-emitting devices reach positions at an interval of about 700 μm. In the first embodiment, the position of the electron-emitting device is shifted in the direction away from the spacer from the position obtained by vertically projecting each irradiation point on the rear substrate by 950 μm for the closest device, by 550 μm for the second closest device, by 350 μm for the third closest device, by 250 μm for the fourth closest device, and 50 μm for the fifth closest device. The sixth closest device and subsequent devices are not shifted in the direction away from the spacer because of little influence of deflection by the electrical charges of the spacer.

More specifically, the distance from the position obtained by vertically projecting each irradiation position on the rear substrate to the device arrangement position is set in accordance with the distance from the spacer to the device. By setting this distance larger for devices closer to the spacer, the irradiation positions can be arranged at almost the same interval.

Note that in the first embodiment, a soda-lime glass is used as a material for the insulated spacer substrate. If, however, another glass material such as a borosilicate glass, an insulating ceramic such as alumina or alumina nitride, or a resin such as Teflon is used, the same effects as those described above can be obtained. Each of these materials has a surface sheet resistance of $10^{11}$ Ω/sq or more, or $10^{12}$ Ω/sq or more. By using such a material for the spacer of the first embodiment, the charge amount can be kept almost constant owing to the resistance characteristic. In other words, it is desirable to use a material having a surface sheet resistance of $10^{11}$ Ω/sq or more, and more preferably $10^{12}$ Ω/sq or more.

(Second Embodiment)

In the second embodiment, the height d of a spacer 1020 is decreased from 4 mm (first embodiment) to 2 mm.

The distances D1, D2, D3, D4, and D5 from the spacer 1020 to respective devices were properly adjusted to about 3,050 μm, about 2,550 μm, about 1,900 μm, about 1,350 μm, and about 900 μm. Then, the electron spot intervals Q1, Q2, Q3, Q4, and Q5 on a face plate 1017 became almost the same as about 700 μm. In this manner, by properly adjusting the height of the spacer 1020 and the distance (position) to the device, electrons emitted by even devices near the spacer 1020 can form electron spots on the face plate 1017 at almost the same interval. An image free from image distortion caused by the charge-up of the spacer 1020 and a decrease in luminance can be formed.

In the second embodiment, the device pitches are set in the above-described manner in order to arrange, at an interval of 700 μm, positions where an image forming member is irradiated with electrons emitted by the respective electron-emitting devices. The spacer is set to make its center coincide with the center between electron-emitting devices adjacent to each other through the spacer. Therefore, electrons emitted by the devices closest to the spacer reach positions spaced apart from the side surfaces of the spacer by about 250 μm. Electrons emitted by the second closest devices reach positions spaced apart from the side surfaces of the spacer by about 950 μm. Electrons emitted by the third closest devices reach positions spaced apart from the side surfaces of the spacer by about 1,650 μm. Electrons emitted by the fourth closest devices reach positions spaced apart from the side surfaces of the spacer by about 2,350 μm. Electrons emitted by the fifth closest devices reach positions spaced apart from the side surfaces of the spacer by about 3,050 μm. In the second embodiment, since the fifth closest device is hardly influenced by the spacer, it is formed immediately below a position where an electron spot is formed. Electrons emitted by subsequent electron-emitting devices reach positions at an interval of about 700 μm. In the second embodiment, the position of the electron-emitting device is shifted in the direction away from the spacer from the position obtained by vertically projecting each irradiation point on the rear substrate by 650 μm for the closest device, by 400 μm for the second closest device, by 250 μm for the third closest device, and by 200 μm for the fourth closest device. The fifth closest device and subsequent devices are not shifted in the direction away from the spacer because of little influence of deflection by the electrical charges of the spacer.

As described above, even when the height d of the spacer 1020 is changed, the influence of the charge-up of the spacer 1020 can be corrected by adjusting the positions of devices near the spacer 1020 in advance. That is, a decrease in height of the spacer 1020 allows a decrease in interval between the spacer 1020 and the device.

(Third Embodiment)

In the third embodiment, the accelerating voltage Va is increased from 3 kV (first embodiment) to 6 kV.

In this case, the distances D1, D2, D3, D4, and D5 from a spacer 1020 to respective devices were properly adjusted to about 3,050 μm, about 2,550 μm, about 1,950 μm, about 1,450 μm, and about 900 μm. Then, the electron spot intervals Q1, Q2, Q3, Q4, and Q5 on a face plate 1017 became almost the same as about 700 μm. In this manner, by properly adjusting the height of the spacer 1020 and the distance (position) to the device, electrons emitted by even devices near the spacer 1020 can form electron spots on the face plate 1017 at almost the same interval. An image free from image distortion caused by the charge-up of the spacer 1020 and a decrease in luminance can be formed.

In the third embodiment, the device pitches are set in the above-described manner in order to arrange, at an interval of 700 μm, positions where an image forming member is irradiated with electrons emitted by the respective electron-emitting devices. The spacer is set to make its center coincide with the center between electron-emitting devices adjacent to each other through the spacer. Therefore, electrons emitted by the devices closest to the spacer reach positions spaced apart from the side surfaces of the spacer by about 250 μm. Electrons emitted by the second closest devices reach positions spaced apart from the side surfaces of the spacer by about 950 μm. Electrons emitted by the third closest devices reach positions spaced apart from the side surfaces of the spacer by about 1,650 μm. Electrons emitted by the fourth closest devices reach positions spaced apart from the side surfaces of the spacer by about 2,350 μm. Electrons emitted by the fifth closest devices reach positions spaced apart from the side surfaces of the spacer by about 3,050 μm. In the third embodiment, since the fifth closest device is hardly influenced by the spacer, it is formed immediately below a position where an electron spot is formed. Electrons emitted by subsequent electron-emitting devices reach positions at an interval of about 700 μm. In the third embodiment, the position of the electron-emitting device is shifted in the direction away from the spacer from the position obtained by vertically projecting each irradiation point on the rear substrate by 650 μm for the closest device, by 500 μm for the second closest device, by 300 μm for the third closest device, and by 200 μm for the fourth closest device. The fifth closest device and subsequent devices are not shifted in the direction away from the spacer because of little influence of deflection by the electrical charges of the spacer.

As described above, when the accelerating voltage Va is increased, if the interval between the spacer 1020 and the device is decreased, the influence of the charge-up of the spacer 1020 can be corrected.

(Fourth Embodiment)

In the fourth embodiment, a driving voltage (device voltage) Vf for each device is changed, while the device voltage is kept at 16 V in the above-mentioned embodiments.

The driving voltage Vf was changed from 12 V up to 19 V, and the devices were driven. Even upon changing the driving voltage Vf, the deviation amount in the y-axis direction, i.e., the direction close to the spacer 1020 did not change. For this reason, similar to the first embodiment, the distances D1, D2, D3, D4, and D5 from the spacer 1020 to respective devices were set to about 3,100 μm, about 2,600 μm, about 2,000 μm, about 1,500 μm, and about 1,200 μm. Then, the spot intervals Q1, Q2, Q3, Q4, and Q5 on a face plate 1017 between electrons emitted by the respective devices became almost the same as about 700 μm. Electron spots could be formed on the face plate at the same interval.

From this, an image free from image distortion caused by the charge-up of the spacer and a decrease in luminance can be obtained. That is, by employing the above device arrangement, the present invention can be preferably practiced even when the device (driving) voltage Vf is changed from 12 V to 19 V.

(Fifth Embodiment)

In the fifth embodiment, an FE type or MIM type cold cathode device is used as an electron source. In the fifth embodiment as well as the case using an SCE type device as a cold cathode device, an image free from image distortion caused by the charge-up of the spacer and a decrease in luminance can be obtained by adjusting the position of the device in accordance with the distance to the spacer in advance.

As described above, it is the gist of the embodiments of the present invention to correct the influence on the orbit of an electron emitted by a device near the spacer by setting the distance between the device and the spacer 1020 to a predetermined one in advance.

Accordingly, electrons emitted by even devices near the spacer 1020 can form spots on the face plate 1017 at the same interval.

The electron beam source of these embodiments have the following forms.

① The cold cathode device is a cold cathode device having a conductive film including an electron-emitting portion between a pair of electrodes, and preferably an SCE type electron-emitting device.

② The electron source is an electron source having a simple matrix layout in which a plurality of cold cathode devices are wired in a matrix by a plurality of row-direction wirings and a plurality of column-direction wirings.

③ The electron source is an electron source having a ladder-shaped layout in which a plurality of rows (to be referred to as a row direction hereinafter) of a plurality of cold cathode devices arranged parallel and connected at two terminals of each device are arranged, and a control electrode (to be referred to as a grid hereinafter) arranged above the cold cathode devices along the direction (to be referred to as a column direction hereinafter) perpendicular to this wiring controls electrons emitted by the cold cathode devices.

④ According to the concepts of the present invention, the present invention is not limited to an image forming apparatus suitable for display. The above-mentioned image forming apparatus can also be used as a light-emitting source instead of a light-emitting diode for an optical printer made up of a photosensitive drum, the light-emitting diode, and the like. At this time, by properly selecting M row direction wirings and N column-direction wirings, the image forming apparatus can be applied as not only a linear light-emitting source but also a two-dimensional light-emitting source. In this case, the image forming member is not limited to a substance which emits light upon collision with electrons, such as a fluorescent substance in the above-described embodiments, but may be a member on which a latent image is formed by charging of electrons.

As has been described above, according to the present invention, collision of electrons with a support member can be suppressed, and the positional shift amount between an electron irradiation point near the support member and an electron irradiation point free from deflection by the support member can be decreased. When the present invention is applied to an image forming apparatus, failure to form a beam spot near the support member can be prevented, and a decrease in image quality near the support member can be suppressed.

As many apparently widely different embodiments of the present invention can be made without departing from the spirit and scope thereof, it is to be understood that the invention is not limited to the specific embodiments thereof except as defined in the appended claims.

What is claimed is:

1. An electron apparatus comprising:

a first substrate;

a second substrate arranged to face said first substrate;

a plurality of electron-emitting devices arranged on said first substrate, each of said plurality of electron-emitting devices for emitting at least one electron in a direction towards said second substrate; and a support member arranged for maintaining an interval between said first substrate and said second substrate, wherein said support member has a characteristic of keeping a charge amount almost constant, and wherein at least two of said electron-emitting devices are arranged adjacent to each other through said support member and are separated from one another by a larger interval than an interval separating adjacent ones of said electron-emitting devices adjacent to each other without the mediacy of said support member.

2. The apparatus according to claim 1, wherein A1>(A2+t), wherein A1 is an interval separating said at least two electron-emitting devices arranged on opposite sides of said support member, A2 is an interval separating said adjacent electron-emitting devices that are not arranged on opposite sides of said support member, and t is a thickness of said support member in a direction to connect said at least two electron-emitting devices.

3. The apparatus according to claim 1, wherein the interval separating said at least two electron-emitting devices is such that the size of an interval between irradiation points of electrons emitted by said at least two electron-emitting devices is approximately equal to a size of an interval between irradiation points of electrons emitted by said adjacent electron-emitting devices that are not arranged on opposite sides of said support member.

4. The apparatus according to claim 1, wherein the interval separating said at least two electron-emitting devices is set in accordance with at least one of a voltage for accelerating electrons emitted by said electron-emitting devices, a height of said support member, and a charge amount of said support member.

5. The apparatus according to claim 1, further comprising a plurality of sets of electron-emitting devices arranged substantially linearly.

6. The apparatus according to claim 1, wherein said plurality of electron-emitting devices are wired in a matrix configuration by a row-direction wiring and a column-direction wiring extending along a direction that is different from a direction along which said row-direction wiring extends.

7. The apparatus according to claim 1, wherein said support member is arranged on one of said row-direction wiring and said column-direction wiring.

8. The apparatus according to claim 1, wherein said electron-emitting device is a cold cathode type electron-emitting device.

9. The apparatus according to claim 1, wherein each of said electron-emitting devices has a pair of electrodes and emits an electron upon application of a voltage to said pair of electrodes.

10. The apparatus according to claim 1, wherein each electron-emitting device is a surface-conduction emission type electron-emitting device.

11. The apparatus according to claim 1, wherein said electron-emitting devices are driven at a certain period, and the characteristic of said support member for keeping the charge amount almost constant is a characteristic capable of suppressing a change in charge amount within an allowable range for a change in a deflection amount applied to electrons emitted by said electron-emitting devices upon a change in charge amount of said support member during at least the certain period.

12. The apparatus according to claim 11, wherein $A1 > (A2+t)$, wherein A1 is an interval separating said at least two electron-emitting devices arranged on opposite sides of said support member, A2 is an interval separating said adjacent electron-emitting devices that are not arranged on opposite sides of said support member, and t is a thickness of said support member in a direction to connect said at least two electron-emitting devices.

13. The apparatus according to claim 11, wherein the interval separating said at least two electron-emitting devices is such that the size of an interval between irradiation points of electrons emitted by said at least two electron-emitting devices is approximately equal to a size of an interval between irradiation points of electrons emitted by said adjacent electron-emitting devices that are not arranged on opposite sides of said support member.

14. The apparatus according to claim 11, wherein the interval separating said at least two electron-emitting devices is set in accordance with at least one of a voltage for accelerating electrons emitted by said electron-emitting devices, a height of said support member, and a charge amount of said support member.

15. The apparatus according to claim 11, further comprising a plurality of sets of electron-emitting devices arranged substantially linearly.

16. The apparatus according to claim 11, wherein said plurality of electron-emitting devices are wired in a matrix configuration by a row-direction wiring and a column-direction wiring extending along a direction that is different from a direction along which said row-direction wiring extends.

17. The apparatus according to claim 16, wherein said support member is arranged on one of said row-direction wiring and said column-direction wiring.

18. The apparatus according to claim 11, wherein said electron-emitting device is a cold cathode type electron-emitting device.

19. The apparatus according to claim 1, wherein each of said electron-emitting devices has a pair of electrodes and emits an electron upon application of a voltage to said pair of electrodes.

20. The apparatus according to claim 11, wherein each electron-emitting device is a surface-conduction emission type electron-emitting device.

* * * * *

UNITED STATES PATENT AND TRADEMARK OFFICE

CERTIFICATE OF CORRECTION

PATENT NO. : 6,288,485 B1
DATED : September 11, 2001
INVENTOR(S) : Tsuyoshi Takegami et al.

It is certified that error appears in the above-identified patent and that said Letters Patent is hereby corrected as shown below:

Title page,
Item [56], References Cited, OTHER PUBLICATIONS, after "Ajluni, C.," "come" should read -- Come --.

Column 3,
Line 26, "be cause" should read -- because --.

Column 7,
Line 27, "view" should read -- views --;
Line 61, close up left margin;
Line 62, close up right margin;
Line 63, close up left margin; and
Line 64, close up right margin.

Column 11,
Line 5, "embodiment" (second occurrence) should read -- invention --.

Column 12,
Line 25, "in" should be deleted.

Column 14,
Line 59, "mixture" should read -- mixtures --.

Column 15,
Line 50, "Difference" should read -- A difference --.

Column 16,
Line 35, "describe d" should read -- described --.

Column 17,
Line 39, "generate s" should read -- generates --.

UNITED STATES PATENT AND TRADEMARK OFFICE

CERTIFICATE OF CORRECTION

PATENT NO. : 6,288,485 B1
DATED : September 11, 2001
INVENTOR(S) : Tsuyoshi Takegami et al.

It is certified that error appears in the above-identified patent and that said Letters Patent is hereby corrected as shown below:

Column 21,
Line 32, "Numeral" should read -- Numerals --.

Column 27,
Line 18, "claim 1," should read -- claim 6, --;

Column 28,
Line 35, "claim 1," should read -- claim 11, --.

Signed and Sealed this

Twentieth Day of August, 2002

*Attest:*

*Attesting Officer*

JAMES E. ROGAN
*Director of the United States Patent and Trademark Office*